US008251835B2

(12) United States Patent
Abe

(10) Patent No.: US 8,251,835 B2
(45) Date of Patent: Aug. 28, 2012

(54) GOLF CLUB HEAD

(75) Inventor: Hiroshi Abe, Kobe (JP)

(73) Assignee: SRI Sports Limited, Kobe (JP)

( * ) Notice: Subject to any disclaimer, the term of this patent is extended or adjusted under 35 U.S.C. 154(b) by 270 days.

(21) Appl. No.: 12/778,666

(22) Filed: May 12, 2010

(65) Prior Publication Data

US 2010/0317458 A1 Dec. 16, 2010

(30) Foreign Application Priority Data

Jun. 10, 2009 (JP) ..... 2009-138763

(51) Int. Cl.
*A63B 53/04* (2006.01)

(52) U.S. Cl. ..... 473/330; 473/331

(58) Field of Classification Search ..... 473/330, 473/331

See application file for complete search history.

(56) References Cited

U.S. PATENT DOCUMENTS

2008/0032814 A1 2/2008 Ban
2008/0167138 A1* 7/2008 Ban et al. ..... 473/331

FOREIGN PATENT DOCUMENTS

JP 09-070457 3/1997
JP 10-179824 7/1998
JP 2008-36155 A 2/2008
JP 2008-161658 A 7/2008

* cited by examiner

*Primary Examiner* — Michael Dennis
(74) *Attorney, Agent, or Firm* — Birch, Stewart, Kolasch & Birch, LLP

(57) ABSTRACT

A golf club head includes a face line. A depth D1 (mm) is 0.100 (mm) or greater and 0.508 (mm) or less. A first curvature radius r1 is smaller than a second curvature radius r2. An upper end point of an edge of the face line is Pa. A point placed at a position where a depth is 0.015 mm is Pb. A point placed at a position where a depth is 0.030 mm is Pc. A point placed at a position where a depth is [(D1−0.03)/2+0.03] (mm) is Pd. A point placed at a position where a depth is [D1/4] (mm) is Pe. The first curvature radius is a radius of a circle passing through the point Pa, the point Pb, and the point Pc; and the second curvature radius is a radius of a circle passing through the point Pc, the point Pd, and the point Pe.

19 Claims, 19 Drawing Sheets

GOLF CLUB HEAD

This application claims priority on Patent Application No. 2009-138763 filed in JAPAN on Jun. 10, 2009, the entire contents of which are hereby incorporated by reference.

BACKGROUND OF THE INVENTION

1. Field of the Invention

The present invention relates to a golf club head having face lines.

2. Description of the Related Art

Face lines are formed on many golf club heads. The face lines can contribute to increase in a backspin rate of a hitting ball. The face lines can suppress fluctuation in the backspin rate.

On the other hand, the face lines may damage the ball. The damage includes also fine splitting. While the face lines having a sharp edge can contribute to increase in a spin rate, the face lines are apt to damage the ball.

Japanese Patent Application Laid-Open No. 2008-36155 (US2008/032814 A1) discloses a golf club head having face lines having an edge to which a roundness having a radius of 0.2 mm or less is formed.

SUMMARY OF THE INVENTION

The present invention has considered a section shape of a face line based on new technical concept. It was found that the face line can realize both suppression of a damage of a ball and spin performance.

It is an object of the present invention to provide a golf club capable of enhancing the spin performance while suppressing the damage of the ball.

A golf club head according to the present invention includes a face; and a face line formed on the face. A depth D1 (mm) of the face line is 0.100 (mm) or greater and 0.508 (mm) or less. When a first curvature radius is defined as r1 (mm) and a second curvature radius is defined as r2 (mm) in a section of the face line, the first curvature radius r1 is smaller than the second curvature radius r2. When an upper end point of an edge of the face line is defined as Pa; a point placed at a position of which a depth is 0.015 mm is defined as Pb; a point placed at a position of which a depth is 0.030 mm is defined as Pc; a point placed at a position of which a depth is [(D1−0.03)/2+0.03] (mm) is defined as Pd; and a point placed at a position of which a depth is [D1/4] (mm) is defined as Pe, the first curvature radius r1 is a radius of a circle passing through the point Pa, the point Pb, and the point Pc; and the second curvature radius r2 is a radius of a circle passing through the point Pc, the point Pd, and the point Pe.

Preferably, the first curvature radius r1 is 0.050 (mm) or greater and 0.200 (mm) or less. Preferably, the second curvature radius r2 is 0.100 (mm) or greater and 0.400 (mm) or less.

Preferably, a ratio (r1/r2) is 0.1 or greater and 0.7 or less.

Preferably, when a straight line connecting the point Pa and the point Pb is defined as Lab; a straight line connecting the point Pb and the point Pc is defined as Lbc; a straight line connecting the point Pc and the point Pd is defined as Lcd; a straight line connecting the point Pd and the point Pe is defined as Lde; a straight line perpendicular to a land area LA of the face is defined as Lp; an angle between the straight line Lab and the straight line Lp is defined as θ1; an angle between the straight line Lbc and the straight line Lp is defined as θ2; an angle between the straight line Lcd and the straight line Lp is defined as θ3, and an angle between the straight line Lde and the straight line Lp is defined as θ4, the angle θ1 is greater than the angle θ2. Preferably, the angle θ2 is greater than the angle θ3. Preferably, the angle θ3 is greater than the angle θ4.

Preferably, when an angle between a tangent at each of points (excluding the point Pa and the point Pd) between the point Pa and the point Pd and the straight line Lp is defined as θ5, the angle θ5 is smaller as the point is nearer to the point Pd.

DESCRIPTION OF THE PREFERRED EMBODIMENTS

The present invention will be described below in detail based on preferred embodiments with reference to the drawings.

Figure 1:
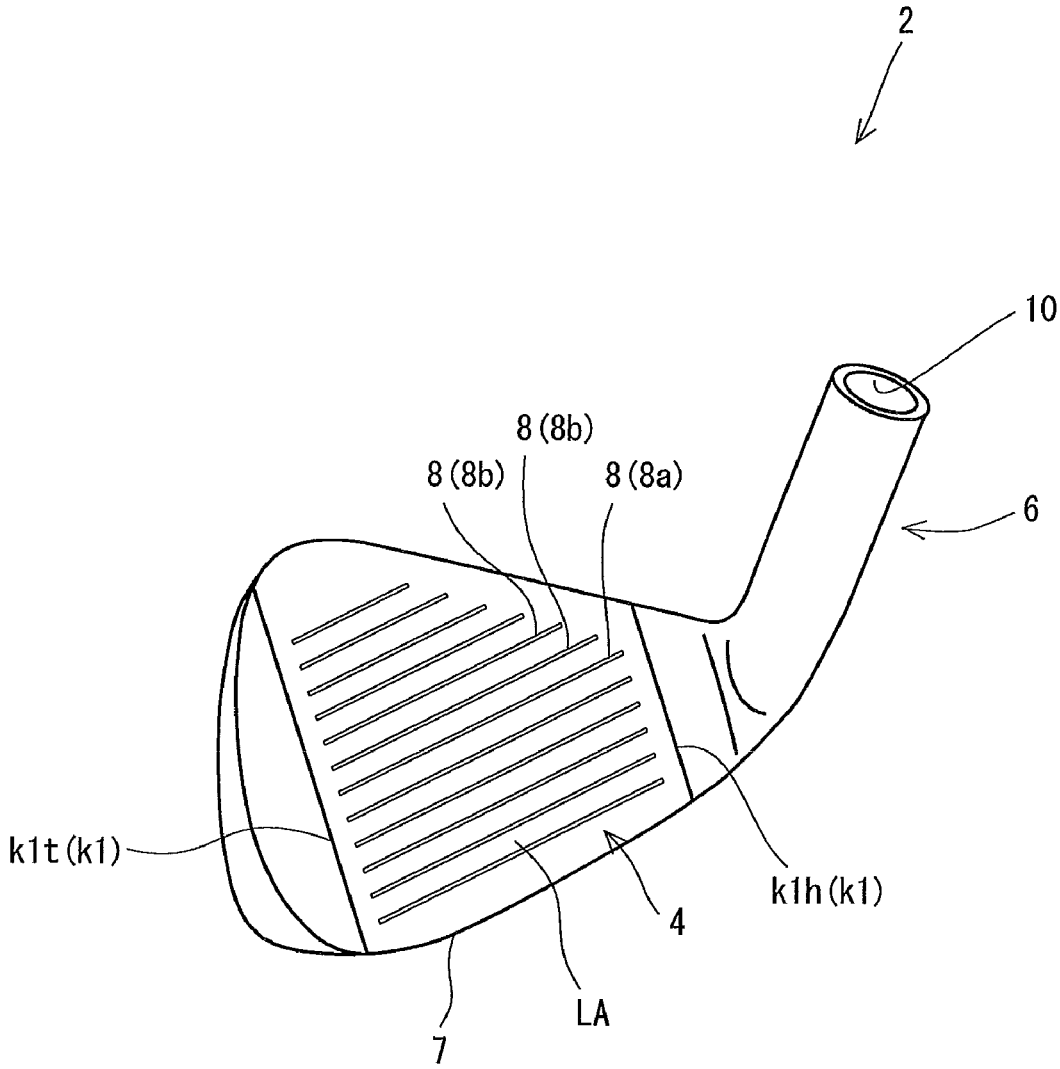
FIG. 1 is a perspective view of a golf club head according to one embodiment of the present invention.
Figure 2:
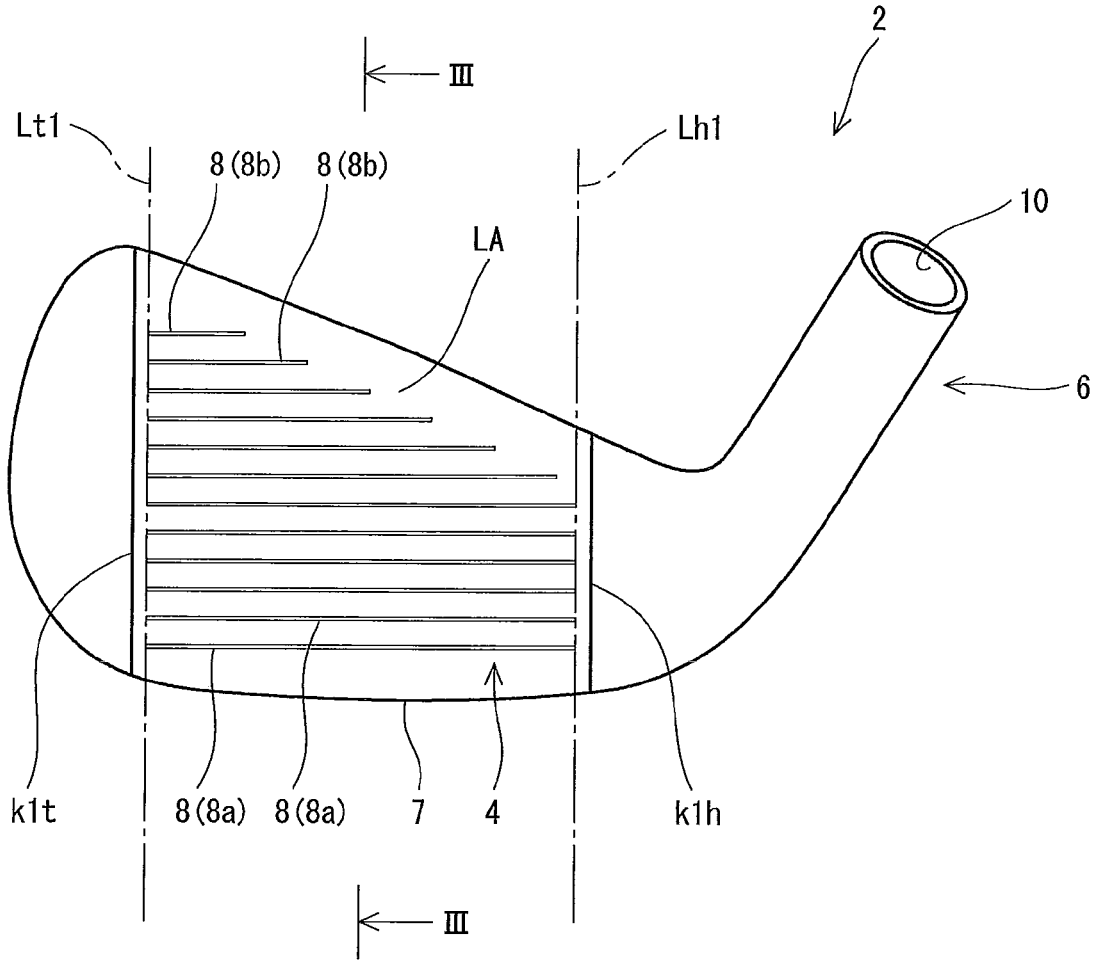
FIG. 2 is a front view of the head of FIG. 1, as viewed from a face side.

As shown in FIGS. 1 and 2, the golf club head 2 is a so-called iron type golf club head. The head is also referred to as an iron head. The head is for right-handed golf players. The golf club head 2 has a face 4, a hosel 6, and a sole 7. The face 4 has a face line 8 formed thereon. The golf club head 2 has a shaft hole 10 to which a shaft is mounted. The shaft hole 10 is formed in the hosel 6.

A material of the head 2 and the face 4 is not restricted. The face 4 may be a metal, or may be a nonmetal. Examples of the metal include iron, stainless steel, maraging steel, pure titanium, and a titanium alloy. Examples of the iron include soft iron (a low carbon steel having a carbon content of less than 0.3 wt %). Examples of the nonmetal include CFRP (carbon fiber reinforced plastic).

The head 2 has the plurality of face lines 8. The face lines 8 are grooves. In the present application, the face lines 8 are also referred to as grooves. The face lines 8 are constituted by the longest lines 8*a* having the longest length and non-longest lines 8*b* shorter than the longest lines 8*a*.

Toe side ends of the longest lines 8*a* are substantially located on one straight line Lt1 (see FIG. 2). Heel side ends of the longest lines 8*a* are substantially located on one straight line Lh1 (see FIG. 2). The straight line Lt1 and the straight line Lh1 are shown by a one-dotted chain line in FIG. 2.

Toe side ends of the non-longest lines 8*b* are substantially located on one straight line Lt1, or are located on the heel side relative to the straight line Lt1. In the head 2 of the embodiment, the toe side ends of all the non-longest lines 8*b* are substantially located on one straight line Lt1. The toe side ends of the non-longest lines 8*b* may be located on the heel side relative to the straight line Lt1.

Heel side ends of the non-longest lines 8*b* are substantially located on one straight line Lh1, or are located on the toe side relative to the straight line Lh1. Usually, the heel side ends of the non-longest lines 8*b* are located on the toe side relative to the straight line Lh1 as in the embodiment of FIG. 2. The heel side ends of the non-longest lines 8*b* are located on a line almost along the contour of the face 4. A distance between each of the heel side ends of the non-longest lines 8*b* and an edge of the face 4 is almost constant.

The face 4 has a land area LA. The land area LA indicates a portion of a surface (face surface) of the face 4 on which the grooves are not formed. If unevenness formed by a shot-blasting treatment to be described later is disregarded, the land area LA is substantially a plane.

A part of the face 4 is subjected to a treatment for adjusting a surface roughness. The typical example of the treatment is the shot-blasting treatment. The treatment will be described later. A boundary line k1 between an area which is subjected to the shot-blasting treatment and an area which is not subjected to the shot-blasting treatment is shown in FIGS. 1 and 2. An area between a toe side boundary line kit and a heel side boundary line k1*h* is subjected to the shot-blasting treatment. All the face lines 8 are formed in the area which is subjected to the shot-blasting treatment. A toe side area relative to the toe side boundary line kit is not subjected to the shot-blasting treatment. A heel side area relative to the heel side boundary line k1*h* is not subjected to the shot-blasting treatment. The toe side boundary line kit and the heel side boundary line k1*h* are visually recognized by the absence and presence of the shot-blasting treatment. The shot-blasting treatment can increase the surface roughness. The increased surface roughness can increase the backspin rate of a ball. The increase in the backspin rate tends to stop the ball near the point of fall. The increase in the backspin rate can facilitate the stopping of the ball at the aiming point. The increase in the backspin rate is particularly useful for a shot targeting a green and an approach shot.

As shown in FIG. 2, the straight line Lt1 and the boundary line kit are substantially parallel. The straight line Lh1 and the boundary line k1*h* are substantially parallel. The straight line Lt1, the boundary line kit, the straight line Lh1, and the boundary line k1*h* are substantially parallel.

The toe side boundary line k1*t* is located on the toe side of the straight line Lt1. The heel side boundary line k1*h* is located on the heel side of the straight line Lh1.

The face surface may be polished before processing the face lines 8. The face surface of a head 2*p* before the face lines 8 are formed can be smoothed by polishing the face surface.

The face surface may be polished after processing the face lines 8. The land area LA can be flattened by polishing the face surface. A roundness may be applied to the edge of the face line 8 by the polishing.

A treatment (the shot-blasting treatment described above, or the like) for adjusting a surface roughness may be carried out before processing the face lines 8. The treatment for adjusting the surface roughness may be carried out after processing the face lines 8

Figure 3:
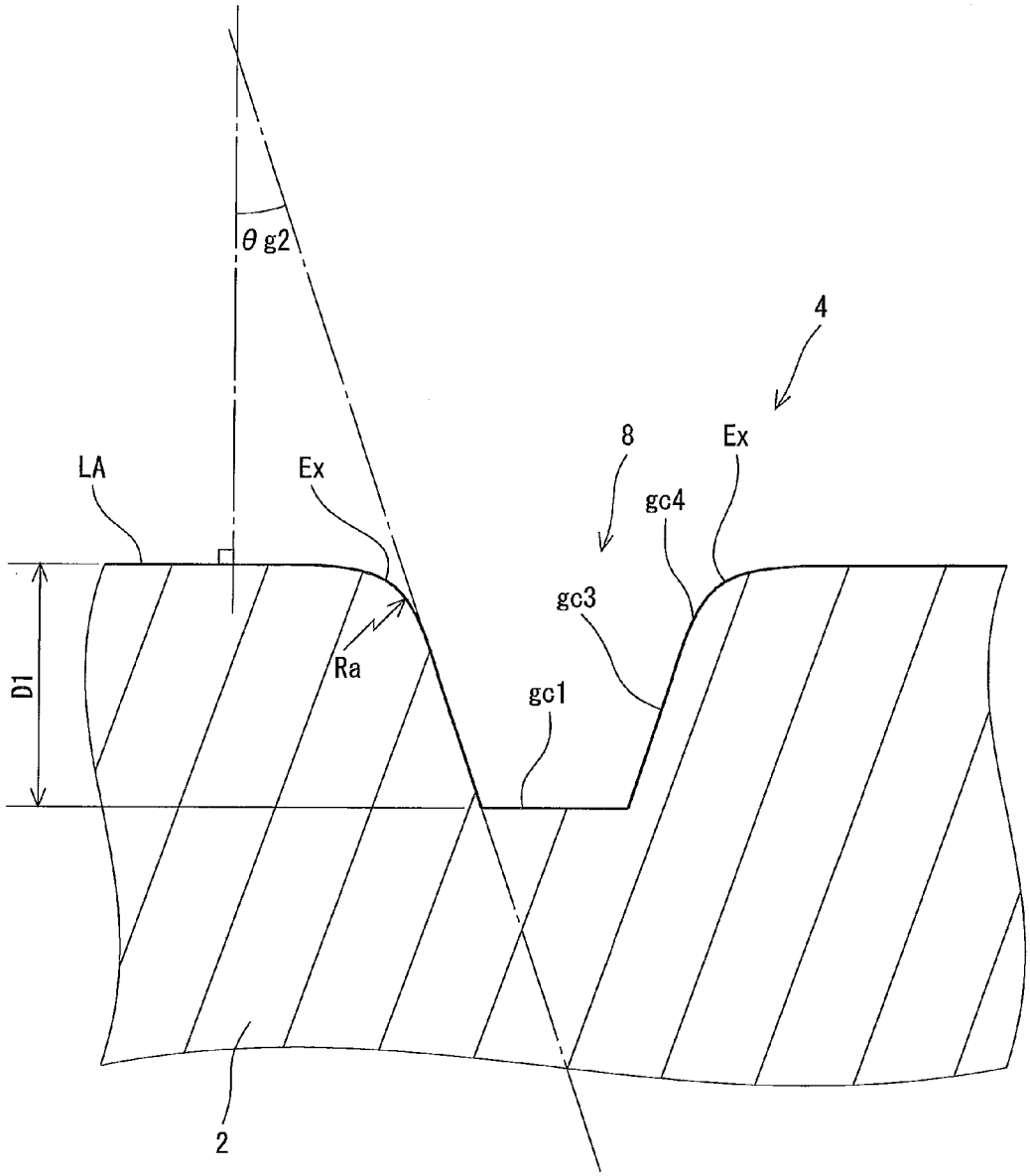
FIG. 3 is a diagram in which a part of a section taken along a line of FIG. 2 is expanded.

FIG. 3 is a sectional view taken along a line of FIG. 2. FIG. 3 is an enlarged view showing only one face line 8.

As shown in FIG. 3, the face line 8 has a bottom surface gc1, a plane inclined part gc3, and a protruded curved surface gc4. The whole or a part of the protruded curved surface gc4 is an edge Ex.

The bottom surface gc1 is a plane. The plane is parallel to the land area LA. The bottom surface gc1 may not be a plane. For example, the bottom surface gc1 may be a curved surface, or may be an inclined surface. In respect of enlarging an area A1 (described later) of a transverse plane of a groove to enhance spin performance, the bottom surface gc1 is preferably a plane.

The plane inclined part gc3 may be present, or may not be present. In respect of enlarging the area A1 (described later) of the transverse plane of the groove to enhance the spin performance, it is preferable that the plane inclined part gc3 is present.

Figure 4:
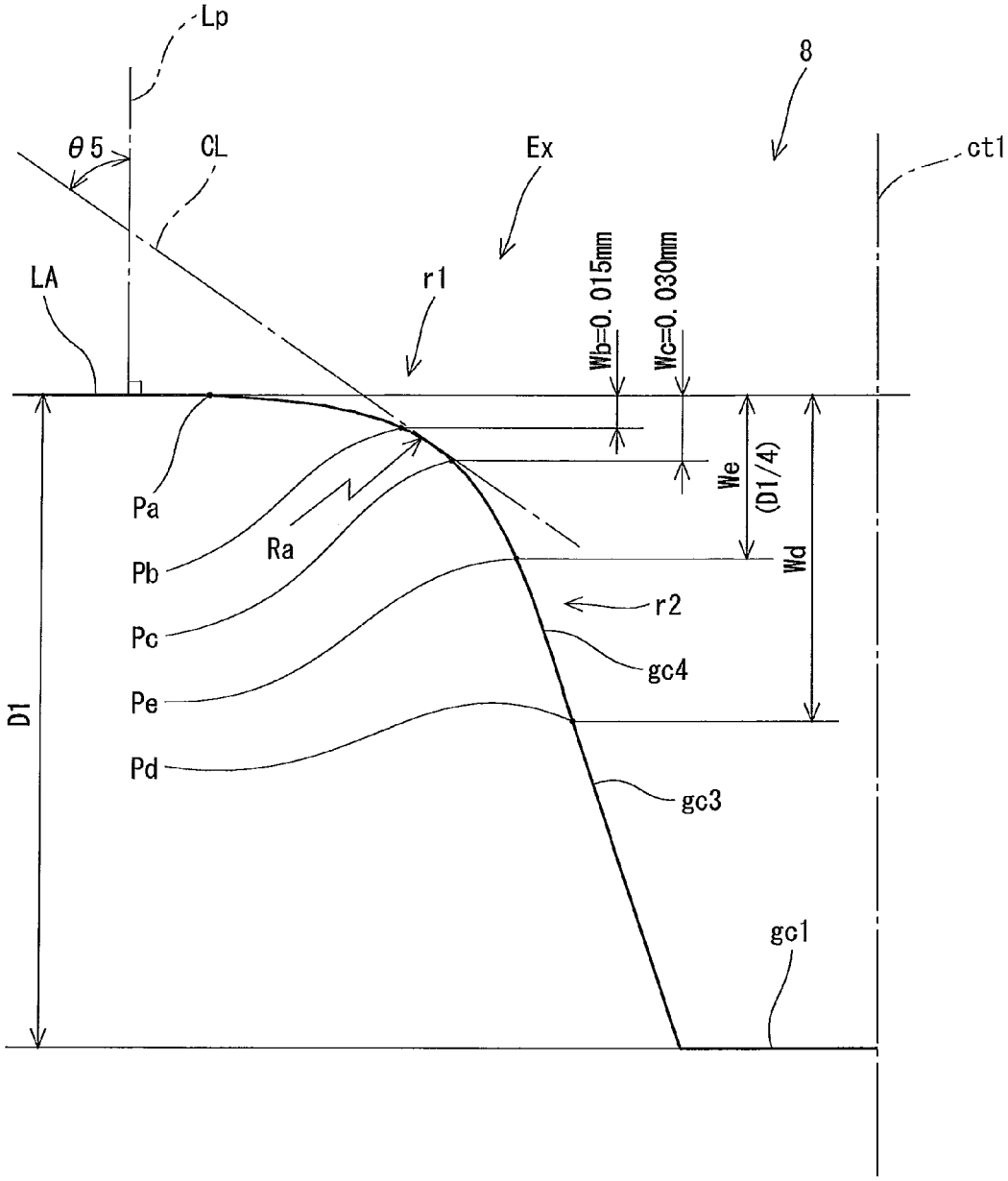
FIG. 4 is a expanded diagram of a section line of FIG. 3.
Figure 5:
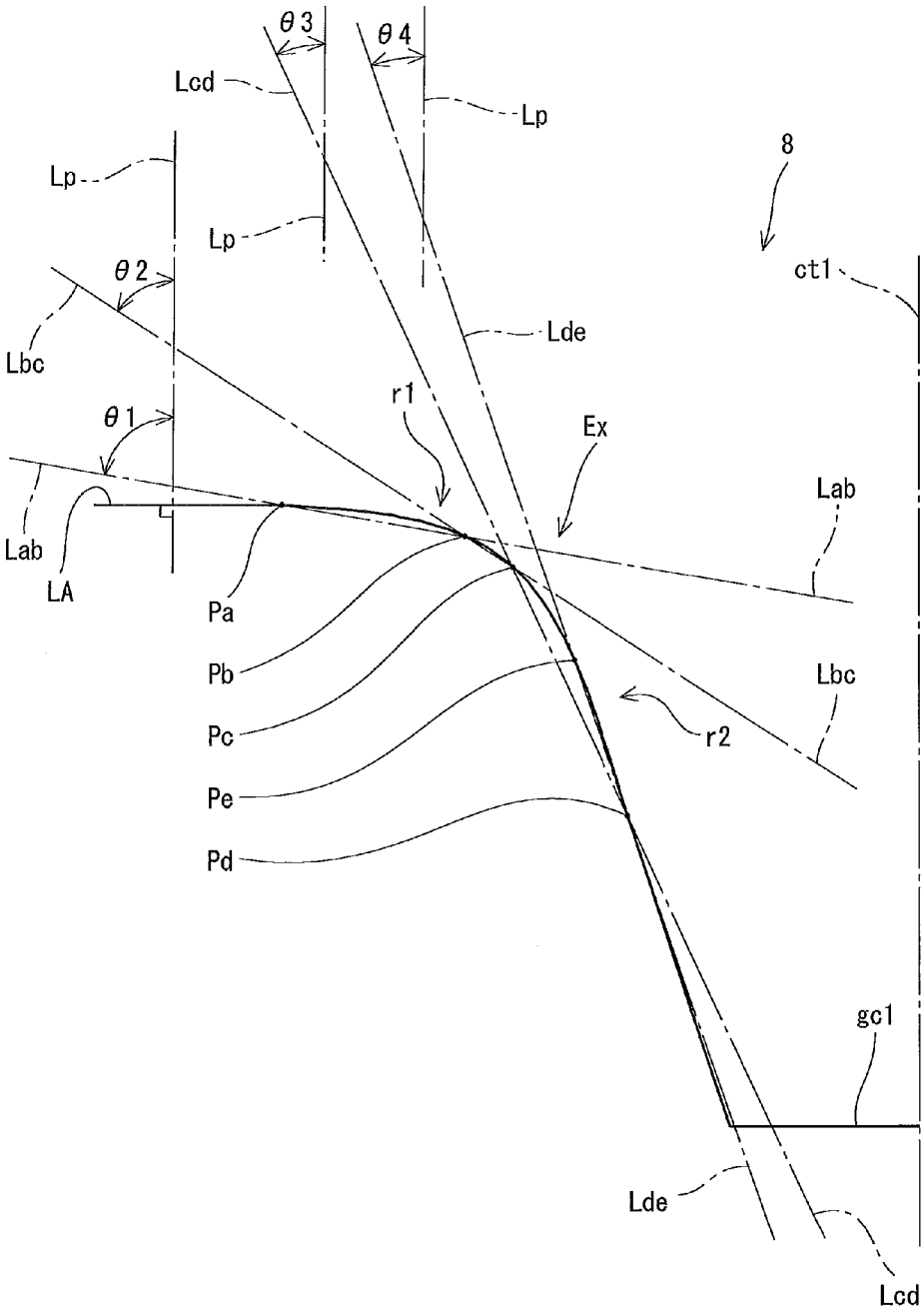
FIG. 5 is a expanded diagram of the section line of FIG. 3 as in FIG. 4.

FIGS. 4 and 5 are enlarged views showing a section line of a surface of the face line 8. The section shape of the face line 8 is symmetrical. The section shape of the face line 8 is axisymmetric about a central line ct1. Only the left side portion of the central line ct1 is shown in FIGS. 4 and 5.

In the embodiment, the entire protruded curved surface gc4 is smoothly continuously formed. At least a part of the protruded curved surface gc4 may not be smoothly continuously formed. In respect of suppressing the damage of the ball, it is preferable that the entire protruded curved surface gc4 is smoothly continuously formed.

The protruded curved surface gc4 and the land area LA are smoothly continuously formed. The protruded curved surface gc4 and the land area LA may not be smoothly continuously formed. In respect of suppressing the damage of the ball, it is preferable that the protruded curved surface gc4 and the land area LA are smoothly continuously formed. In other words, it is preferable that the edge Ex and the land area LA are smoothly continuously formed.

The protruded curved surface gc4 and the plane inclined part gc3 are smoothly continuously formed. The protruded curved surface gc4 and the plane inclined part gc3 may not be smoothly continuously formed.

In the present application, a point Pa, a point Pb, a point Pc, a point Pd, and a point Pe are defined. The point Pa, the point Pb, the point Pc, the point Pd, and the point Pe are points present on the surface of the face line 8. The point Pa, the point Pb, the point Pc, the point Pd, and the point Pe are points present on the section line of the surface of the face line 8.

An upper end point of the edge Ex of the face line 8 is the point Pa (see FIG. 4). The point Pa is a boundary between the land area LA and the face line 8.

A point placed at a position of which a depth is 0.015 mm is the point Pb (see FIG. 4). In other words, a depth Wb of the point Pb is 0.015 (mm).

A point placed at a position of which a depth is 0.030 mm is the point Pc (see FIG. 4). In other words, a depth We of the point Pc is 0.030 (mm).

A depth (mm) of a point Pd is calculated by the following formula (F1).

$$(D1-0.03)/2+0.03 \quad \text{(F1)}$$

In the formula (F1), numeral character D1 designates a groove depth (mm). The groove depth D1 is shown by a double-pointed arrow D1 in FIG. 4.

A point placed at a position of which a depth is [D1/4] (mm) is a point Pe (see FIG. 4). The point Pe is usually located between the point Pc and the point Pd.

The depths of the point Pa, the point Pb, the point Pc, the point Pd, and the point Pe are measured along a direction perpendicular to the land area LA.

In respect of the golf rules, the groove depth (the depth of the face line) D1 (mm) is preferably equal to or less than 0.508 (mm), and more preferably equal to or less than 0.470 (mm). When the groove depth D1 is excessively small, dischargeability of water may be reduced to reduce spin performance in a wet condition. When the groove depth D1 is excessively small, lawn grass and earth included in the face line 8 are hard to be removed. The lawn grass and earth may reduce the spin performance. In these respects, the groove depth D1 is preferably equal to or greater than 0.100 (mm), more preferably equal to or greater than 0.200, still more preferably equal to or greater than 0.300 (mm), and particularly preferably equal to or greater than 0.400 (mm).

In the present application, a first curvature radius r1 (mm) and a second curvature radius r2 (mm) are defined.

The first curvature radius r1 is a radius of a circle passing through the point Pa, the point Pb, and the point Pc. The illustration of the circle is abbreviated.

The second curvature radius r2 is a radius of a circle passing through the point Pc, the point Pd, and the point Pe. The illustration of the circle is abbreviated.

The first curvature radius r1 being smaller than the second curvature radius r2 was found to be effective. More specifically, it was found that the setting of $r1<r2$ can realize both resistance to the damage of the ball and the spin performance.

The value of the first curvature radius r1 is not restricted. In respect of suppressing the damage of the ball, the first curvature radius r1 is preferably equal to or greater than 0.050 (mm), more preferably equal to or greater than 0.080 (mm), and still more preferably equal to or greater than 0.100 (mm). When the first curvature radius r1 is excessively great, an edge effect is apt to be reduced. When the first curvature radius r1 is excessively great, an area A1 of a transverse plane of a groove is apt to be excessively reduced. Therefore, the excessively great first curvature radius r1 is apt to reduce the spin performance. In these respects, the first curvature radius r1 is preferably equal to or less than 0.200 (mm), and more preferably equal to or less than 0.150 (mm).

The value of the second curvature radius r2 is not restricted. When the second curvature radius r2 is excessively small, the upper part of the edge Ex and the land area LA are apt to be nearly in parallel with each other, whereby the spin performance is apt to be reduced. In hitting the ball at a great head speed, a surface layer part of the ball is apt to enter the face line 8. When the second curvature radius r2 is excessively small, the ball is apt to be damaged in hitting the ball at the great head speed. In these respects, the second curvature radius r2 is preferably equal to or greater than 0.100 (mm), more preferably equal to or greater than 0.200 (mm), and still more preferably equal to or greater than 0.250 (mm). When the second curvature radius r2 is excessively great, the dischargeability of water (water drainage) may be deteriorated. When the second curvature radius r2 is excessively great, the area A1 of the transverse plane of the groove may be excessively reduced. They are apt to cause reduction in the spin performance in the wet condition. The spin performance in the wet condition is spin performance in a condition in which water adheres to the ball and/or the face. In these respects, the second curvature radius r2 is preferably equal to or less than 0.400 (mm), more preferably equal to or less than 0.350 (mm), and still more preferably equal to or less than 0.300 (mm).

The curvature radius Ra at each of the points between the point Pa and the point Pb may be constant, or may not be constant. In respect of suppressing the damage of the ball, it is preferable that the curvature radius Ra at each of the points between the point Pa and the point Pb is gradually increased as approaching to the point Pa.

The curvature radius Ra at each of the points between the point Pa and the point Pc may be constant, or may not be constant. In respect of suppressing the damage of the ball, it is preferable that the curvature radius Ra at each of the points between the point Pa and the point Pc is gradually increased as approaching to the point Pa.

It is preferable that a curvature radius Ra at each of points of the point Pa and the point Pc is in a preferred range of the first curvature radius r1. More specifically, it is preferable that the maximum value of the curvature radius Ra at the points between the point Pa and the point Pc is equal to or less than the upper limit value of the preferred range of the first curvature radius r1. It is preferable that the minimum value of the curvature radius Ra at the points between the point Pa and the point Pc is equal to or greater than the lower limit value of the preferred range of the first curvature radius r1. The reason for the preferred value range thereof is the same as that of the first curvature radius r1.

The curvature radius Ra at each of the points between the point Pb and the point Pc may be constant, or may not be constant. In respect of suppressing the damage of the ball, it is preferable that the curvature radius Ra at each of the points between the point Pb and the point Pc is gradually increased as approaching to the point Pb.

The curvature radius Ra at each of the points between the point Pc and the point Pe may be constant, or may not be constant In respects of suppressing the damage of the ball and the dischargeability of water, it is preferable that the curvature radius Ra at each of the points between the point Pc and the point Pe is gradually increased as approaching to the point Pc.

The curvature radius Ra at each of the points between the point Pd and the point Pe may be constant, or may not be constant. In respect of the dischargeability of water, the curvature radius Ra at each of the points between the point Pd and the point Pe may be gradually decreased as approaching to the point Pe.

It is preferable that a curvature radius Ra at each of points between the point Pc and the point Pd is in a preferred range of the second curvature radius r2. More specifically, it is preferable that the maximum value of the curvature radius Ra at the points between the point Pc and the point Pd is equal to or less than the upper limit value of the preferred range of the second curvature radius r2. It is preferable that the minimum value of the curvature radius Ra at the points between the point Pc and the point Pd is equal to or greater than the lower limit value of the preferred range of the second curvature radius r2. The reason for the preferred value range thereof is the same as that of the second curvature radius r2.

A ratio (r1/r2) is smaller than 1.0. When the ratio (r1/r2) is excessively great, the first curvature radius r1 is excessively great, or the second curvature radius r2 is excessively small. These may have an influence on the spin performance and the damage of the ball in hitting the ball at the great head speed. In views of the spin performance and the damage of the ball, the ratio (r1/r2) is preferably equal to or less than 0.7, more preferably equal to or less than 0.5, still more preferably equal to or less than 0.4, and particularly preferably equal to or less than 0.33.

When the ratio (r1/r2) is excessively small, the first curvature radius r1 is excessively small, or the second curvature radius r2 is excessively great. The excessively small first curvature radius r1 has an influence on the damage of the ball. The excessively great second curvature radius r2 may reduce the water drainage or excessively reduce the area A1 of the transverse plane of the groove. These have an influence on the spin performance in the wet condition. In respect of the spin performance in the wet condition, the ratio (r1/r2) is preferably equal to or greater than 0.1, more preferably equal to or greater than 0.2, and still more preferably equal to or greater than 0.25.

It was found that the conformity to the golf rules can be enhanced by setting the first curvature radius r1 to be smaller than the second curvature radius r2. It was found that the conformity to the golf rules can be enhanced by setting the first curvature radius r1, the second curvature radius r2 and/or the ratio (r1/r2) to the preferred values. The golf rules will be described later.

As shown in FIG. 5, a straight line connecting the point Pa and the point Pb is defined as Lab. A straight line connecting the point Pb and the point Pc is defined as Lbc. A straight line connecting the point Pc and the point Pd is defined as Lcd. A straight line connecting the point Pd and the point Pe is defined as Lde. A straight line perpendicular to the land area LA of the face is defined as Lp.

As shown in FIG. 5, an angle between the straight line Lab and the straight line Lp is defined as θ1. An angle between the straight line Lbc and the straight line Lp is defined as θ2. An angle between the straight line Lcd and the straight line Lp is defined as θ3. An angle between the straight line Lde and the straight line Lp is defined as θ4.

In the embodiment, the angle θ1 is greater than the angle θ2. In the embodiment, the angle θ2 is greater than the angle θ03. In the embodiment, the angle θ3 is greater than the angle θ4. In the embodiment, θ1>θ2>θ3>θ4 is set. This magnitude relation tends to discharge water included in the face line 8. More specifically, the dischargeability of water (water drainage) is good. The dischargeability of water can enhance the spin performance in the wet condition. This magnitude relation can suppress the damage of the ball.

The angle θ1 is not restricted. In respect of suppressing the damage of the ball, the angle θ1 is preferably equal to or greater than 45 degrees, more preferably equal to or greater than 50 degrees, still more preferably equal to or greater than 60 degrees, and particularly preferably equal to or greater than 65 degrees. In respect of the spin performance, the angle θ1 is preferably equal to or less than 89 degrees, more preferably equal to or less than 85 degrees, still more preferably equal to or less than 80 degrees, and particularly preferably equal to or less than 75 degrees.

The angle θ2 is not restricted. In respect of suppressing the damage of the ball, the angle θ2 is preferably equal to or greater than 40 degrees, more preferably equal to or greater than 45 degrees, and still more preferably equal to or greater than 50 degrees. In respect of the spin performance, the angle θ2 is preferably equal to or less than 80 degrees, more preferably equal to or less than 75 degrees, still more preferably equal to or less than 70 degrees, still more preferably equal to or less than 65 degrees, and particularly preferably equal to or less than 60 degrees.

The angle θ3 is not restricted. In respect of suppressing the damage of the ball, the angle θ3 is preferably equal to or greater than 20 degrees, more preferably equal to or greater than 25 degrees, still more preferably equal to or greater than 30 degrees, and particularly preferably equal to or greater than 35 degrees. In respects of the dischargeability of water (water drainage) and the spin performance in the wet condition, the angle θ3 is preferably equal to or less than 70 degrees, more preferably equal to or less than 65 degrees, still more preferably equal to or less than 60 degrees, still more preferably equal to or less than 55 degrees, still more preferably equal to or less than 50 degrees, and particularly preferably equal to or less than 45 degrees.

The angle θ4 is not restricted. In views of suppressing the damage of the ball and easiness in manufacturing, the angle θ4 is preferably equal to or greater than 3 degrees, more preferably equal to or greater than 6 degrees, still more preferably equal to or greater than 8 degrees, and particularly preferably equal to or greater than 10 degrees. In respects of the dischargeability of water (water drainage) and the spin performance in the wet condition, the angle θ4 is preferably equal to or less than 45 degrees, more preferably equal to or less than 30 degrees, and still more preferably equal to or less than 20 degrees.

In views of suppressing the damage of the ball, the dischargeability of water, and the spin performance, it is preferable that the section line of the face line is smoothly continuously formed between the point Pa and the point Pd.

In views of suppressing the damage of the ball, the dischargeability of water, and the spin performance, it is preferable that a tangent CL is present at all points (excluding the point Pa and the point Pd) between the point Pa and the point Pd. An example of the tangent CL is shown in FIG. 4.

In views of suppressing the damage of the ball, the dischargeability of water, and the spin performance, it is preferable that an angle θ5 between the tangent CL at each of points between the point Pa and the point Pd and the straight line Lp is smaller as the point is nearer to the point Pd. An example of the tangent CL and an example of the angle θ5 are shown in FIG. 4.

A manufacturing method of a head of the present invention includes a processing step of the face line. The processing step of the face line is not restricted. As the processing step of the face line, the following items (a) and (b) are exemplified.

(a) A step of carrying out cut processing of the face line using a cutter.

(b) A step of forcing a face line mold on a face to form the face line, the face line mold having a protruded part corresponding to the shape of the face line.

The face line mold in the step (b) may be referred to as a "face line engraved mark" by a person skilled in the art.

The step (b) has been conventionally carried out. On the other hand, the step (a) can be conducted by using an NC processing machine. NC implies numerical control.

Figure 6:
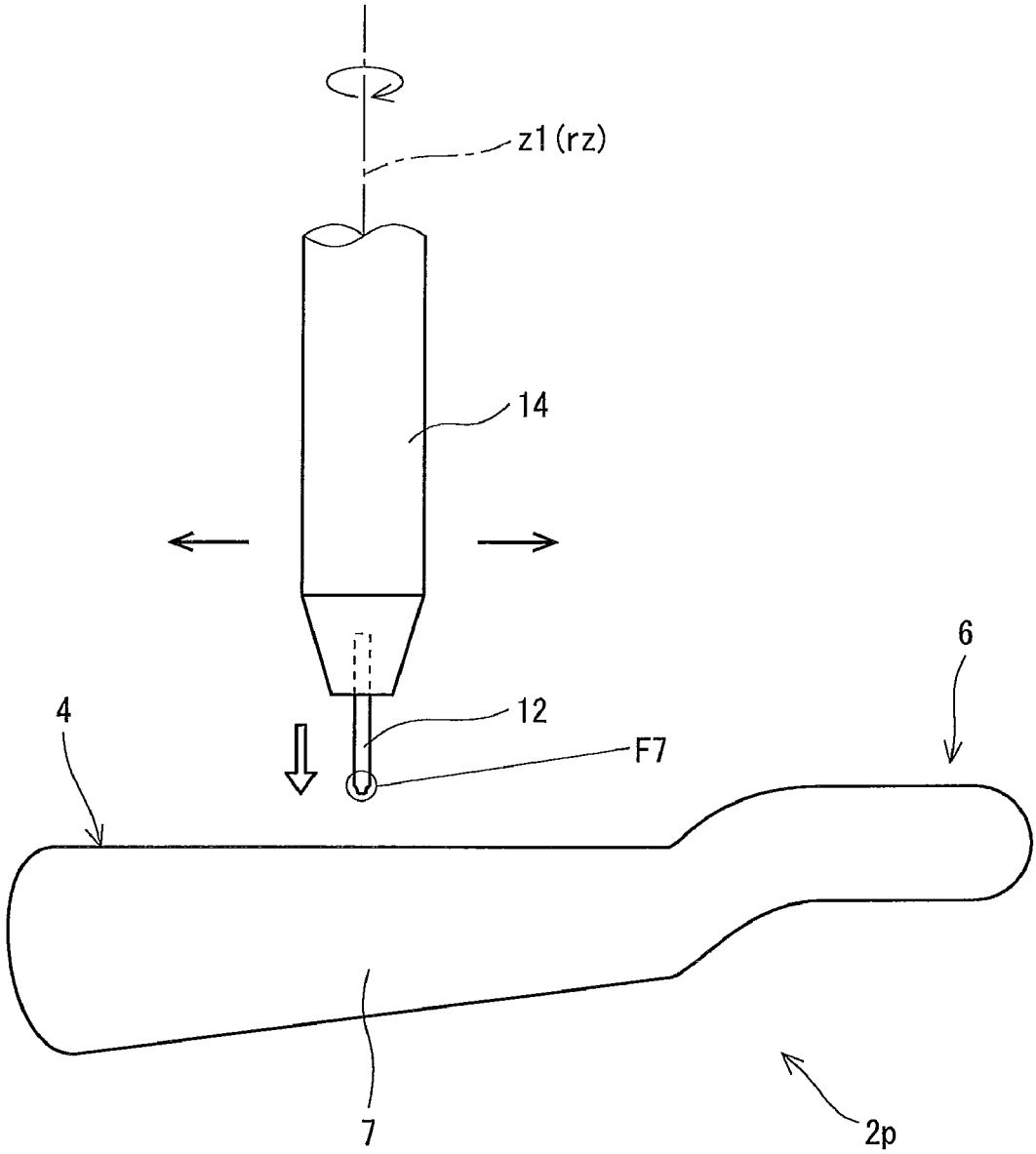
FIG. 6 is a diagram for explaining one embodiment of cut processing by a cutter.

FIG. 6 is a diagram for explaining an example of a step for processing the face line 8. FIG. 6 shows an example of the step (a).

In the step, first, a head 2*p* before the face line 8 is formed is prepared. In the present application, the head 2*p* is also referred to as a pre-line forming head. The pre-line forming head is an example of a pre-line forming member. As shown in FIG. 6, the head 2*p* is fixed with the face 4 horizontally set and faced upward. The head 2*p* is fixed by a jig, which is not shown.

The face line 8 is formed by carving. In other words, the face line 8 is formed by cutting. The face line 8 is formed by a cutter 12 which is axially rotated.

As shown in FIG. 6, the cutter 12 is fixed to a base part 14. The base part 14 is a part of an NC processing machine (abbreviated in FIG. 6). The cutter 12 is rotated together with the base part 14. A rotation axis rz of the cutter 12 is equal to a central axis line z1 of the cutter 12.

The cutter 12 is axially rotated. The cutter 12 is moved while the axial rotation is maintained. The cutter 12 is moved to a predetermined cut starting position (a position of an end of the face line) (see arrows of FIG. 6). Next, the cutter 12 descends (see an open arrow of FIG. 6). A position in the vertical direction of the cutter 12 during processing is determined according to the depth of the face line 8 (the groove depth) previously set. Next, the cutter 12 is moved in the longitudinal direction (an almost toe-heel direction) of the face line (the arrows of FIG. 6). The movement follows a straight line. The face 4 is scraped during the movement to form the face line 8. Next, the cutter 12 ascends. The cutting is completed after the ascending. Next, the cutter 12 is moved to a cut starting position of another face line 8. Subsequently, these operations are repeated to process the plurality of face lines 8. The cutter 12 is moved based on a program memorized in the NC processing machine (not shown). The face line 8 having the designed depth is formed at the designed position.

A head obtained by combining a head body with a face plate has been known. An example of such head will be described later in examples. In the head, the head body has an opening. The opening may be a recessed portion, or may be a through hole. The shape of the opening is equivalent to the contour shape of the face plate. In the head, the face plate is fitted into the opening. In the case of such a head, processing of the face line 8 may be carried out preferably in the state of the simple face plate. In this case, a processed object is easily fixed as compared with the case where the head 2*p* is processed as shown in FIG. 6. A face surface are easily disposed in a desired direction (for example, horizontally). In the case of such a head, it is preferable that a face plate having a face line is inserted into a head body. A face plate in which a face line is not processed is an example of a pre-line forming member.

Figure 7:
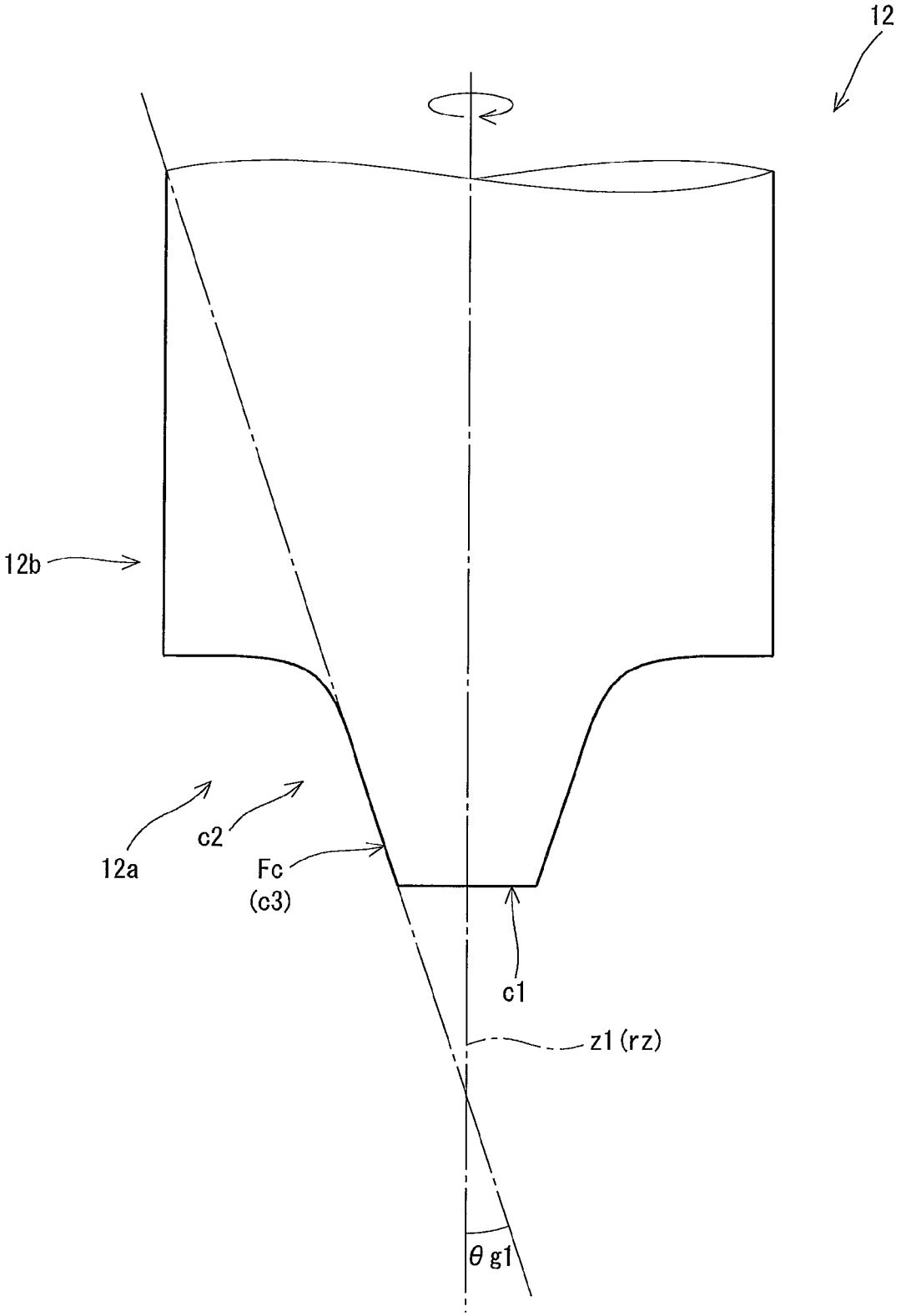
FIG. 7 is a side view showing an example of a cutter.

FIG. 7 is an enlarged view of a tip part (see numeral character F7 in a circle of FIG. 6) of the cutter 12. The cutter 12 has a cutting surface 12*a* and a base body 12*b*. The base body 12*b* has a cylindrical shape. At least a part of the cutting surface 12*a* abuts on the head. At least a part of the cutting surface 12*a* scrapes the head. Usually, a part of the cutting surface 12*a* scrapes the head. The base body 12*b* has a cylindrical shape.

The section of the cutting surface 12*a* in a section perpendicular to the central axis line z1 has a circular shape. The section shape of the cutting surface 12*a* formed by a plane containing the central axis line z1 is equal to the shape of a side surface shown in FIG. 7.

As long as there is no especial explanation, "the section of the cutter" in the present application implies a section formed by a plane containing the central axis line z1. As long as there is no especial explanation, "the section of the face line" in the present application implies a section formed by a plane perpendicular to the land area LA and perpendicular to the longitudinal direction of the face line. An example of "the section of the face line" in the present application is a section taken along a line III-III of FIG. 2.

Figure 8:
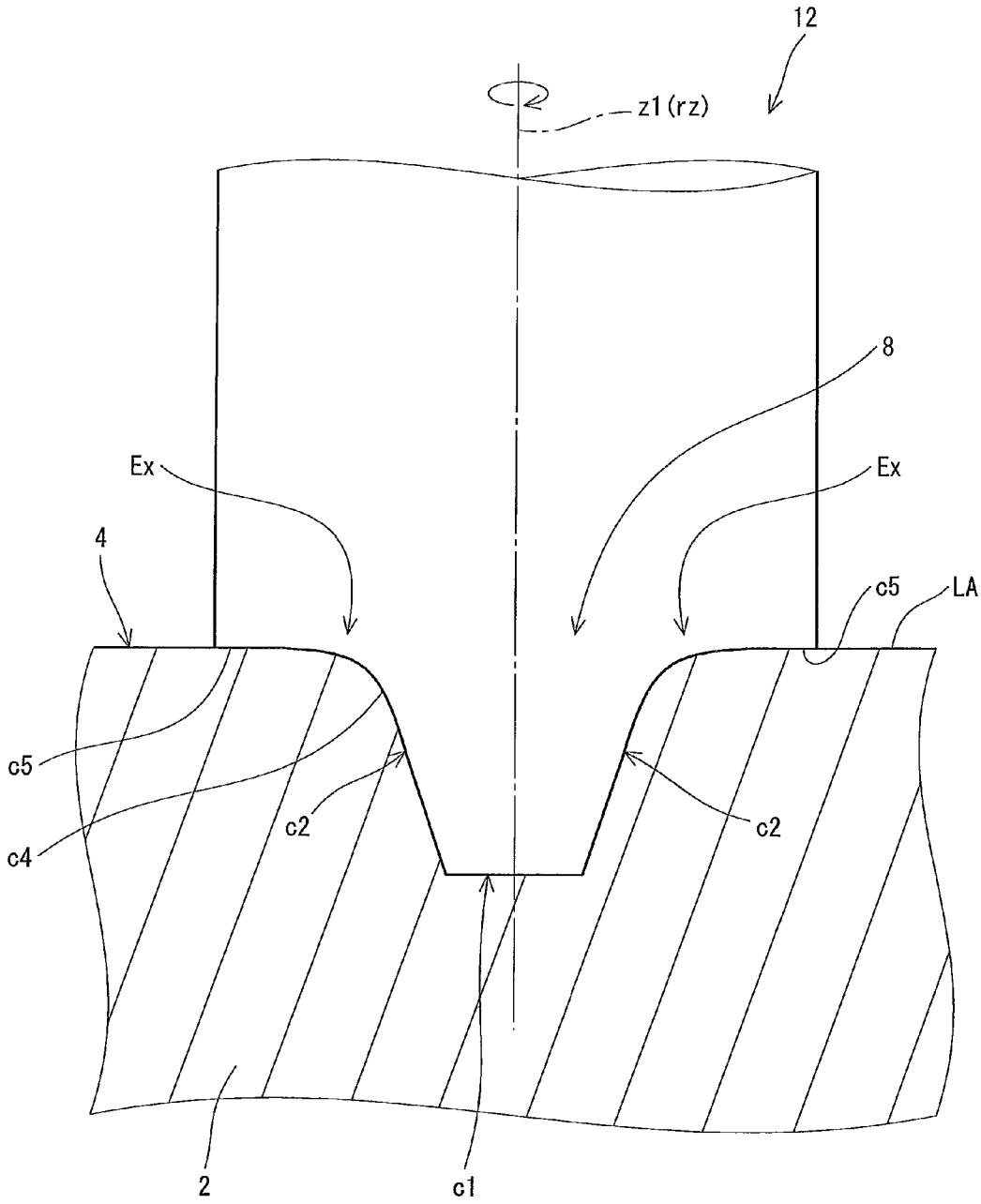
FIG. 8 is a diagram showing a condition in which cut processing of a face line is carried out by the cutter shown in FIG. 7.

FIG. 8 is a partial sectional view showing a condition during the cut processing. The face line 8 having the section shape corresponding to the cutting surface 12*a* is formed by the cut processing. In the embodiment of FIG. 8, the central axis line z1 is perpendicular to the land area LA.

As shown in FIG. 8, the bottom surface gc1 of the face line 8 is scraped by the bottom surface c1. The plane inclined part gc3 of the face line 8 is scraped by a conical surface Fc (first straight part c3). The protruded curved surface gc4 of the face line 8 is scraped by the recessed curved surface c4.

In a direction of the central axis line z1 (a direction perpendicular to the land area LA), the position of the land area LA coincides with the position of the upper side plane part c5. In the embodiment of FIG. 8, the vertical position of the land area LA coincides with the vertical position of the upper side plane part c5. The land area LA is brought into surface-contact with the upper side plane part c5. The upper side plane part c5 is a reference for positioning the cutter 12. The cutter 12 is positioned so that the upper side plane part c5 abuts on the land area LA. Unlike the embodiment of FIG. 8, a clearance may be formed between the upper side plane part c5 and the land area LA. In this case, the cutter 12 is positioned based on the distance of the clearance. The upper side plane part c5 can enhance the position accuracy of the depth-directional position of the cutter 12. The upper side plane part c5 enables the processing of high accuracy.

Figure 9:
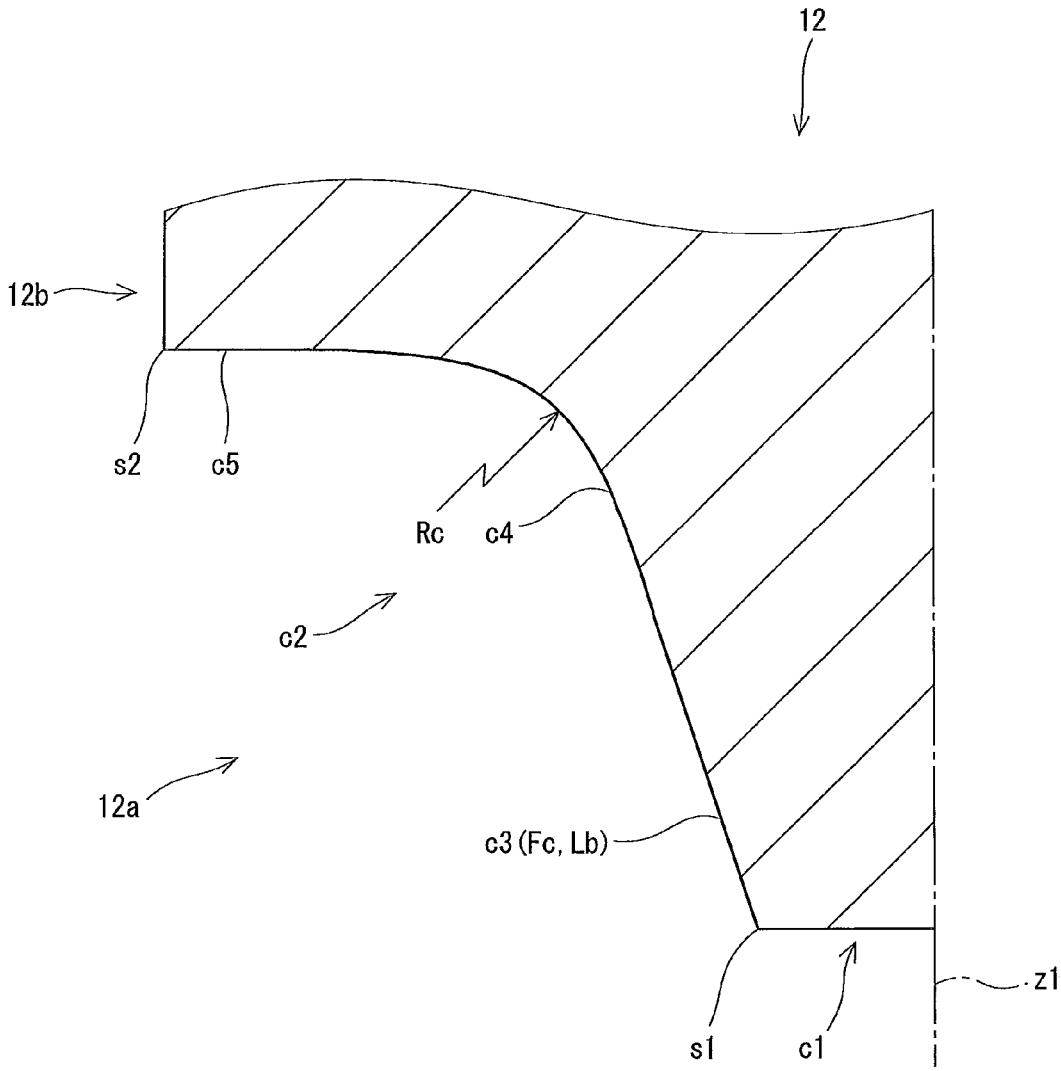
FIG. 9 is a partial sectional view of the cutter shown in FIG. 7.
Figure 10:
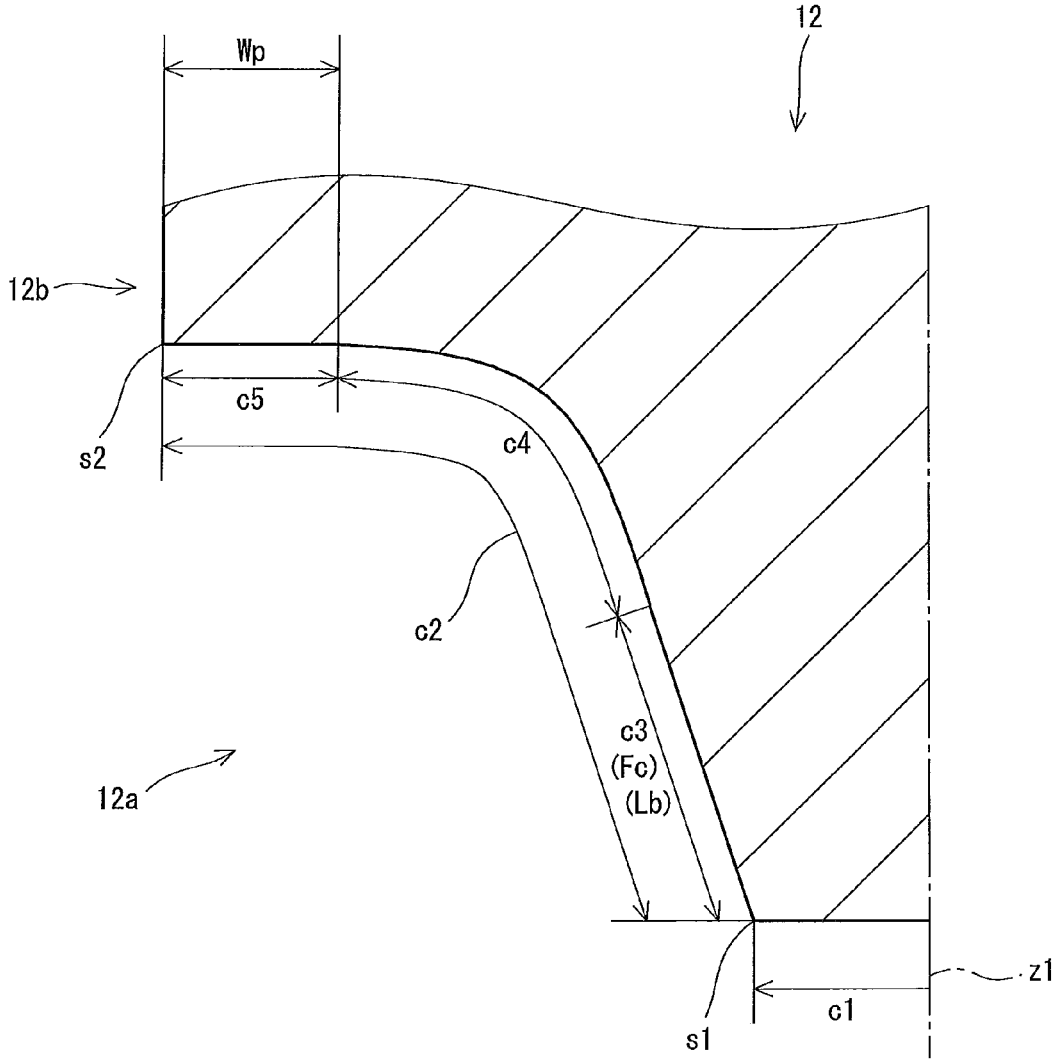
FIG. 10 is a partial sectional view of the cutter shown in FIG. 7 as in FIG. 9.

FIGS. 9 and 10 are sectional views of the tip part of the cutter 12. FIGS. 9 and 10 are sectional views formed by a plane containing the central axis line z1. The sectional view of the cutter 12 is axisymmetric about the central axis line z1. Accordingly, only the left side of the central axis line z1 is shown in FIGS. 9 and 10.

As shown in FIGS. 9 and 10, the cutting surface 12*a* has a bottom surface c1 and a side surface c2. The side surface c2 is located between the base body 12*b* and the bottom surface c1. A boundary between the bottom surface c1 and the side surface c2 is a corner s1. A boundary between a side surface of the base body 12*b* and the side surface c2 is a corner s2.

As shown in FIG. 10, the side surface c2 has a first straight part c3, a curved line part c4, and a second straight part c5. In the cutter 12 of the embodiment, the bottom surface c1 is a plane. In the cutter 12, the bottom surface c1 is a circular plane. The plane is perpendicular to the central axis line z1. The shape of the bottom surface c1 is not restricted. The bottom surface c1 may be a curved surface. The bottom surface c1 may not be perpendicular to the central axis line z1. The bottom surface c1 may be an uneven surface. In respect of enlarging an area A1 (described later) of a transverse plane of the face line 8, the bottom surface c1 is preferably a plane, and more preferably a plane perpendicular to the central axis line z1.

The section of the first straight part c3 is a straight line. The first straight part c3 is a conical surface Fc. The first straight part c3 is a conical protruded surface. The section line of the conical surface Fc is a straight line. The section line of the conical surface Fc is a generating line Lb of the conical surface Fc. The boundary between the conical surface Fc and the bottom surface c1 is the corner s1. In the embodiment, the corner s1 has no roundness. The corner s1 may have a roundness.

The first straight part c3 is also referred to as the conical surface Fc. The conical surface Fc may not be formed. For example, the entire side surface c2 may be the curved line part c4. Comprehensively considering the manufacturing cost of the cutter, the cost of the cut processing, the securement of the area A1 (described later) of the transverse plane of the groove, and the conformity to the rules (described later), it is preferable that the conical surface Fc is formed.

The curved line part c4 is a recessed surface. The recessed surface is a recessed curved surface. The entire recessed curved surface is smoothly continuously formed. The curved line part c4 is also referred to as a recessed curved surface c4. The section of the recessed curved surface c4 is a curve. The shape of the curve is recessed. In other words, the shape of the curve is a protruded shape toward the central axis line z1.

In the preferred embodiment, the protruded curved surface gc4 is formed by the recessed curved surface c4. More specifically, the cut processing by the recessed curved surface c4 forms the protruded curved surface gc4. A section shape of the recessed curved surface c4 corresponds to the section shape of the protruded curved surface gc4. The protruded curved surface gc4 has a curvature radius Rc corresponding to the curvature radius Ra described above.

A face line having an edge having a roundness can be produced with sufficient accuracy by carrying out cut processing using such cutter 12. The error of the first curvature radius r1 and the second curvature radius r2 is suppressed by carrying out cut processing using the cutter 12.

The second straight part c5 is a plane. The second straight part c5 is also referred to as an upper side plane part c5. The upper side plane part c5 is a plane part of an upper end of the side surface c2. The upper side plane part c5 is a plane perpendicular to the central axis line z1. The upper side plane part c5 is an annular plane. The upper side plane part c5 is located between the surface of the base body 12*b* and the recessed curved surface c4. The boundary between the surface of the base body 12*b* and the upper side plane part c5 is the corner s2 (see FIG. 10).

The conical surface Fc and the recessed curved surface c4 are smoothly continuously formed. The recessed curved surface c4 and the upper side plane part c5 are smoothly continuously formed. The entire side surface c2 is smoothly continuously formed. The side surface c2 may have a portion which is not smoothly continuously formed.

A width of the upper side plane part c5 is shown by a double-pointed arrow Wp in FIG. 10. The width Wp is measured along the radial direction of the cutter 12. In respect of the processing accuracy, the width Wp is preferably equal to or greater than 0.1 mm, and more preferably equal to or greater than 0.3 mm. In respect of reducing the manufacturing cost of the cutter 12, the width Wp is preferably equal to or less than mm, more preferably equal to or less than 3 mm, and still more preferably equal to or less than 1 mm.

The upper side plane part c5 may not be present. As described above, in respect of the processing accuracy, it is preferable that the upper side plane part c5 is present.

The edge Ex is formed as a smooth curved surface by the cut processing with the upper side plane part c5 abutting on the land area LA. The smooth curved surface is hard to damage the ball.

According to the embodiment of FIG. 8, the face line 8 having the edge Ex to which a roundness is applied is formed by the recessed curved surface c4. Since the edge Ex is formed by the cut processing, it is not necessary to carry out a step of rounding the edge after the cut processing.

The step of rounding the edge may be carried out after the step in which the face line is formed. As the step of rounding the edge, a surface processing step is exemplified. As the surface processing step, a polishing (buffing) step and a step of adjusting a surface roughness are exemplified.

As the buffing step, for example, a buff using a wire brush is exemplified.

A treatment for applying particles to a face is exemplified as a treatment for adjusting the surface roughness. As the treatment, the shot-blasting treatment is exemplified. The shape of the roundness of the edge may be adjusted by the treatment for adjusting the surface roughness. In consideration of the change of the edge shape caused by the treatment for adjusting the surface roughness, the curvature radius Rc of the cutter 12 may be set. In this case, the curvature radius Rc may be different from the curvature radius Ra. More specifically, in this case, the shape of a recessed curved surface c4 may be different from the shape of the edge Ex.

When the step of rounding the edge is used, a variation in the section shape of the face line is apt to be generated as compared with the case (an embodiment of FIG. 8) where the edge is rounded by the cut processing. In views of suppressing a variation in the roundness of the edge and of the simplification of the step, it is preferable that the roundness of the face line is applied by the cutting step. In the same respect, it is preferable that the step of rounding the edge is not carried out after the cut processing.

When the variation in the roundness of the edge is great, a head having an insufficient roundness and a head having an excessive roundness may be produced. The head having the insufficient roundness is apt to damage the ball. The head having the excessive roundness is apt to reduce the stability of a spin rate particularly in the wet condition. More specifically, the spin rate (particularly, the backspin rate) is apt to vary in a condition in which water is present between the ball and the face. The spin rate (particularly, the backspin rate) is apt to vary even in a condition in which lawn grass is present between the ball and the face. These drawbacks are suppressed by suppressing the variation of the roundness of the edge.

The section shape of the face line is constrained by the golf rules. As described later, the rules are strict. When the conformity to the golf rules is considered in the case where the variation of the roundness is great, a designed value which has margin for a tolerance level on the rules needs to be set. When the variation is great, the objective value (designed value) of the roundness of the edge needs to have margin for the limit on the rules. In this case, for the median value and the average value of the roundness of the edge in a mass-produced product, the curvature radius of the edge is increased to the limit on the rules. The designed value can be brought close to the limit value of the restriction on the rules by enhancing the dimensional accuracy of the roundness of the edge. The design flexibility can be enhanced while maintaining the conformity to the golf rules by enhancing the accuracy of dimension of the edge. There can be manufactured a golf club head which has excellent spin performance and is hard to damage the ball while maintaining the conformity to the golf rules by enhancing the accuracy of dimension of the edge. The golf rules related to the face line will be described later.

An angle between a straight line perpendicular to the land area LA and a plane inclined part gc3 is shown by 0*g*2 in FIG. 3. The angle θg2 is measured in the section of the face line 8. In the present application, the angle θg2 is also referred to as a groove angle.

When the groove width W1 (described later) becomes excessively narrow or the groove angle θg2 becomes close to 0 degree, the face line 8 is apt to be clogged with earth and lawn grass. The clogging of the earth and lawn grass reduces the backspin rate of the ball. The clogging of the earth and lawn grass reduces the stability of the spin rate. In these respects, the groove angle θg2 is preferably equal to or greater than 2 degrees, and more preferably equal to or greater than 3 degrees. When the angle of the edge becomes excessively great, the spin rate of the ball is reduced. In respect of the increase of the spin rate, the groove angle θg2 is preferably equal to or less than 45 degrees, more preferably equal to or less than 30 degrees, and still more preferably equal to or less than 20 degrees.

An angle between a central axis line z1 and a conical surface Fc (first straight part c3) is shown by θg1 in FIG. 7. The angle θg1 is measured in a section formed by a plane containing the central axis line z1. In the present application, the angle θg1 is also referred to as an edge angle.

In respect of setting the groove angle θg2 to the preferred value, the edge angle θg1 is preferably equal to or greater than 2 degrees, and more preferably equal to or greater than 3 degrees. In respect of setting the groove angle θg2 to the preferred value, the edge angle θg1 is preferably equal to or less than 45 degrees, more preferably equal to or less than 30 degrees, and still more preferably equal to or less than 20 degrees.

EXAMPLES

Hereinafter, the effects of the present invention will be clarified by examples. However, the present invention should not be interpreted in a limited way based on the description of the examples.

Example 1

A face plate and a head body used for an iron type golf club head were prepared. The head body for a sand wedge was used. The face plate had a plate shape. The material of the face plate was a titanium alloy. The titanium alloy is "Ti-6Al-4V". The head body has a face part having a recessed part. The face plate was used in combination with the head body. The contour shape of the recessed part is equivalent to the contour shape of the face plate. The depth of the recessed part is equal to the thickness of the face plate. The face plate can be fixed to the recessed part. The fixation is carried out by a screw mechanism. The face plate has a through hole for a screw, which is not shown. The head body has the screw hole. The recessed part has a bottom surface having the screw hole. The face plate is fixed to the recessed part of the head body by tightening the screw. The face plate is removed from the head body by loosening the screw. Thus, the face plate can be attached and detached.

The surface of the face plate serves as a face surface with the face plate mounted to the head body. The real loft of the face surface was set to 56 degrees.

A face line was formed on the face plate. The face line was formed by cut processing. The cut processing was carried out by a method shown in FIG. 8 using a cutter shown in FIGS. 6 and 7. As a result, the face line was formed.

The section shape of the face line was measured. "INFINITE FOCUS optical 3D Measurement Device G4f" (trade name) manufactured by Alicona Imaging GmbH was used for the measurement. The shape of the face line was measured along a direction perpendicular to the longitudinal direction of the face line. The section shape was measured at the center position of the longest line 8*a* as in the position of line of FIG. 2.

Figure 11:
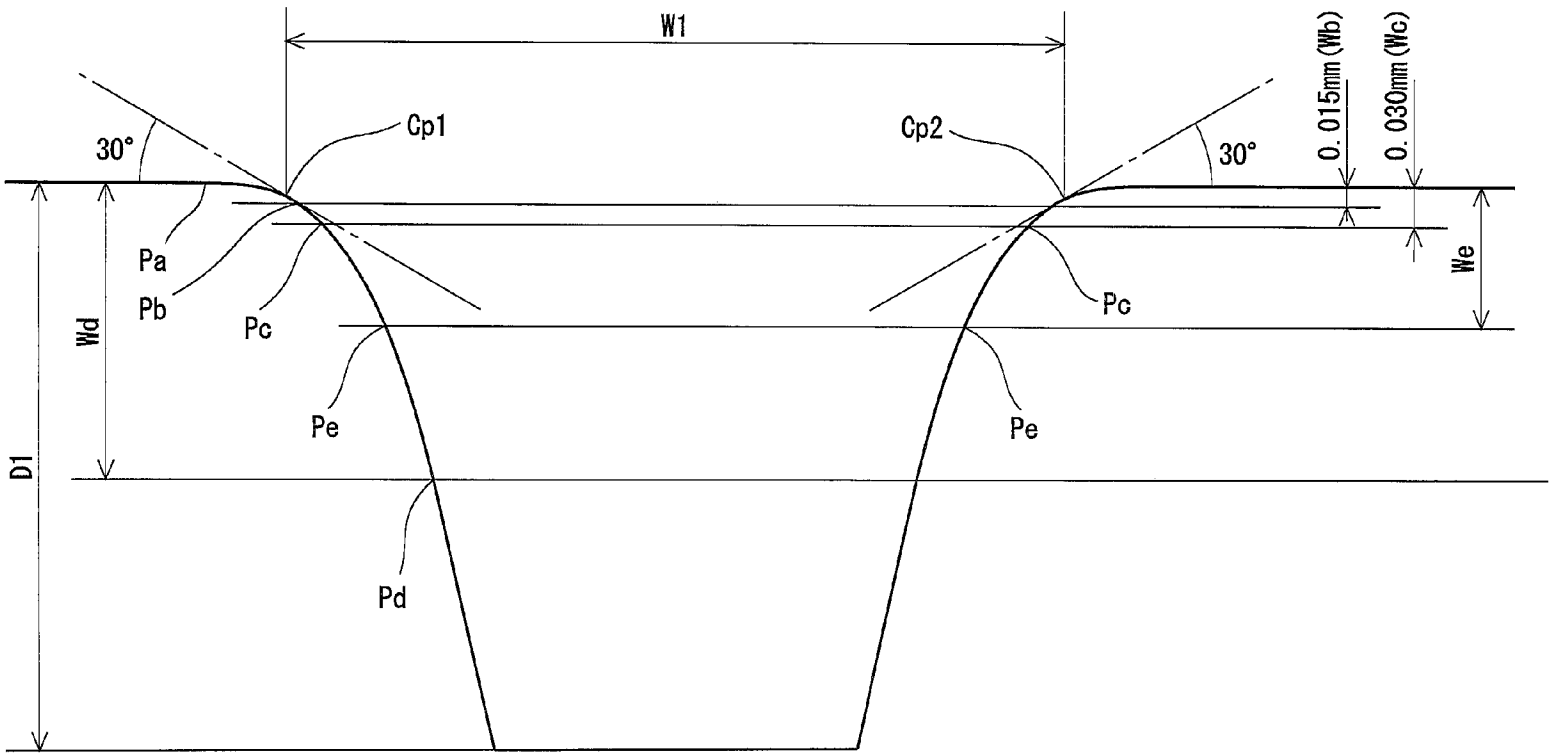
FIG. 11 is a diagram showing a section line of a face line of example 1.

As a result of the measurement, a section line shown in FIG. 11 was obtained. Ten face lines were measured. As a result, ten section lines were obtained. For each of these section lines, the first curvature radius r1, the second curvature radius r2, the angle θ1, the angle θ2, the angle θ3, and the angle θ4 were measured. The average value of ten data is shown in the following Table 1.

A shaft and a grip were mounted to the head body. The face plate of the example 1 was mounted to the recessed part of the head body to obtain a golf club according to the example 1. The golf club was mounted to a swing robot, which hit a golf ball at a head speed of 21 (m/s). A commercially available three-piece ball was used as the golf ball. In the actual shot test by the swing robot, the backspin rate of the golf ball immediately after hitting was measured. The actual shot test was carried out in a wet condition. More specifically, the golf ball was hit immediately after water was applied to the golf ball and a face surface. The golf balls were hit ten times to obtain ten data. The average value of the data of the ten backspin rates is shown in the following Table 1. The average value of the data of the backspin rates is rounded off to the nearest ten.

Example 2, Comparative Example 1 and Comparative example 2

Face plates according to example 2, comparative example 1, and comparative example 2 were obtained in the same manner as in the example 1 except that the shape of the cutter was changed. A test of example 2 was carried out with the face plate of the golf club used in the example 1 replaced by the face plate of the example 2. Similarly, a test of the comparative example 1 was carried out with the face plate of the golf club used in the example 1 replaced by the face plate of the comparative example 1. Similarly, a test of the comparative example 2 was carried out with the face plate of the golf club used in the example 1 replaced by the faceplate of the comparative example 2. More specifically, a test was carried out with only the face plate replaced while the golf club of the example 1 was mounted to the swing robot. Therefore, an actual shot test was carried out in exactly the same condition as the example 1 except that the face plate was replaced. Evaluation was carried out in the same manner as in the example 1. The specifications and evaluation results of the example 2, the comparative example 1, and the comparative example 2 are shown in the following Table 1.

Figure 12:
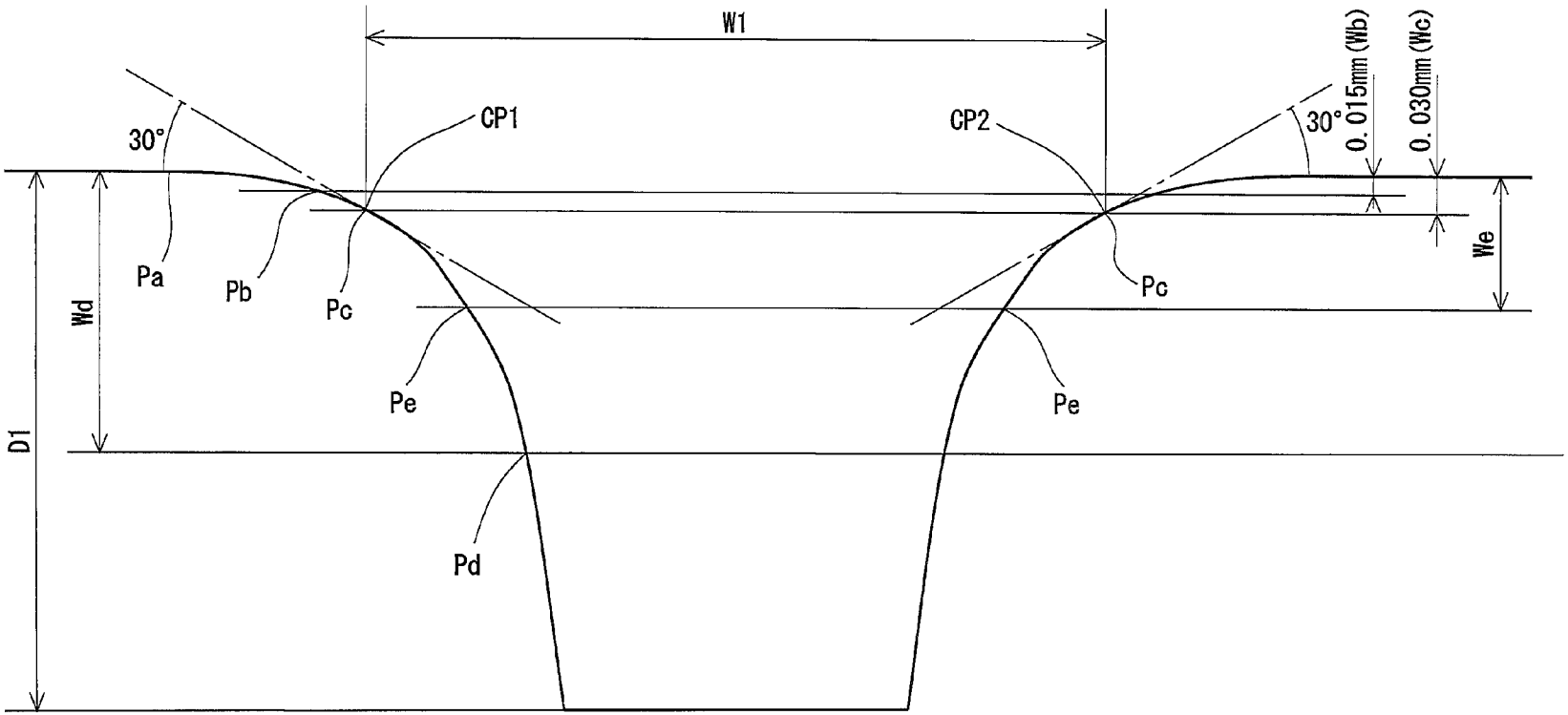
FIG. 12 is a diagram showing a section line of a face line of example 2.
Figure 13:
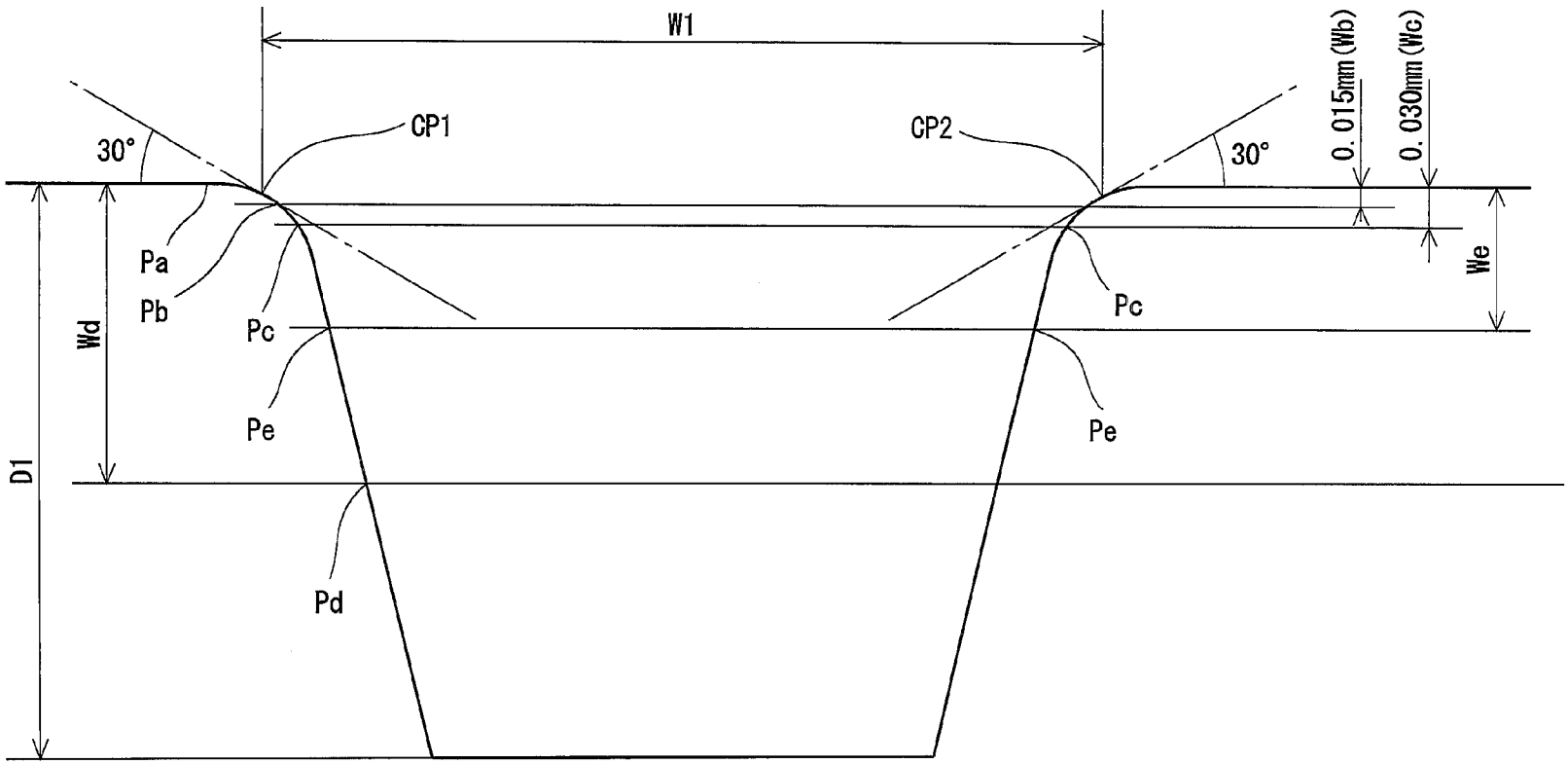
FIG. 13 is a diagram showing a section line of a face line of comparative example 1.
Figure 14:
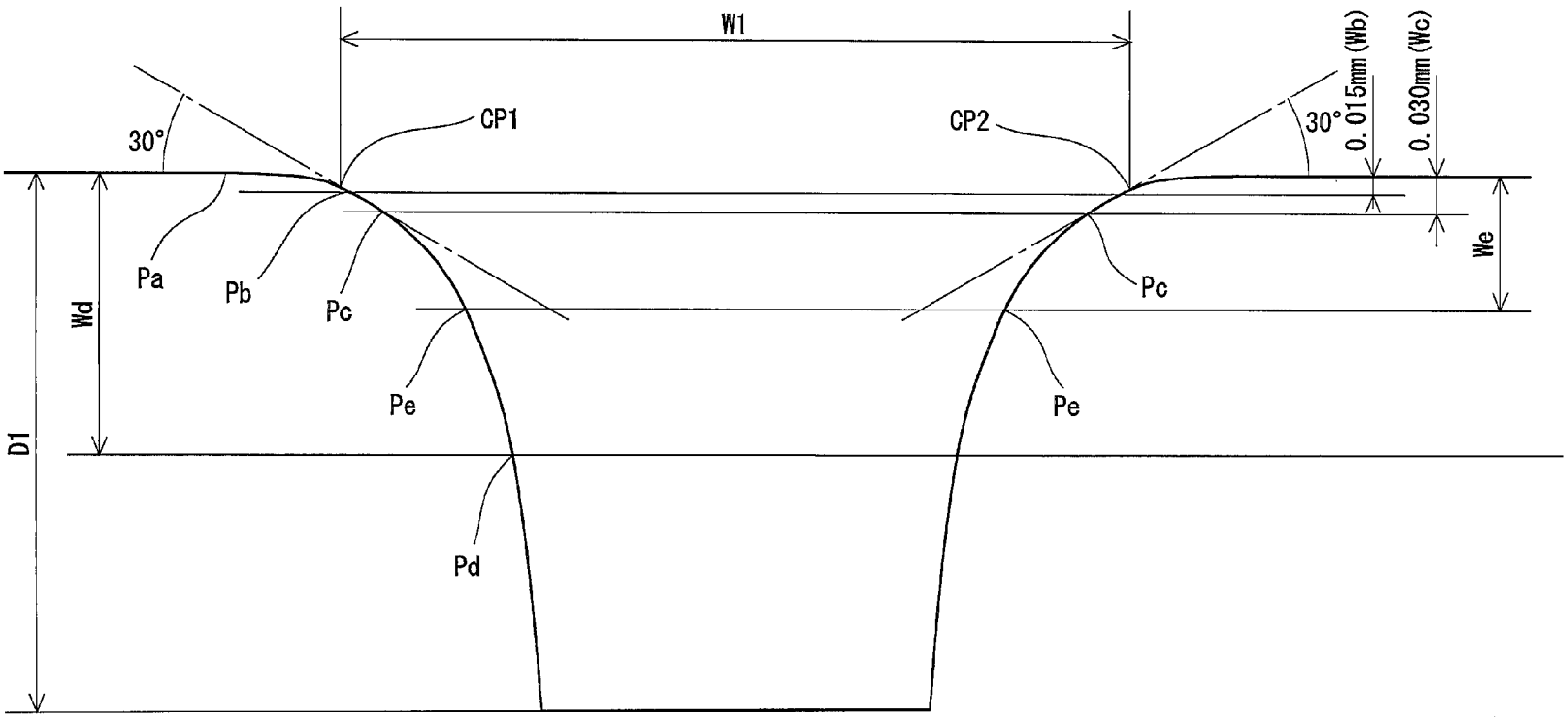
FIG. 14 is a diagram showing a section line of a face line of comparative example 2.

An example of a section line of the example 2 is shown in FIG. 12. An example of a section line of the comparative example 1 is shown in the following FIG. 13. An example of a section line of the comparative example 2 is shown in the following FIG. 14.

[Evaluation of Groove Width W1 and Groove Depth D1]

A groove width W1 and a groove depth D1 were obtained by a method according to the following golf rules. The average value of ten data is shown in the following Table 1.

[Evaluation of Conformity to Rules]

Evaluation was carried out based on the "two circles method" in the golf rules to be described later. When ten measured section lines meet [additional standard 1] of the following "two circles method", and meet the following [additional standard 2], the section lines were evaluated as "good". When the ten measured section lines do not meet [additional standard 1] of the following "two circles method", or do not meet the following [additional standard 2], the section lines were evaluated as "poor". The evaluation result is shown in the following Table 1.

[Description of Golf Rules Related to Face Line]

Hereinafter, the rules related to the face line, including new rules scheduled to be effected from Jan. 1, 2010 will be described. In the description, FIGS. 15 to 19 will be suitably referred. The new rules were announced from R&A (Royal and Ancient Golf Club of Saint Andrews) on Aug. 5, 2008. The Japanese translation of the rules of the face line including the new rules is posted in the homepage of JGA (Japan Golf Association). The address of the JGA homepage in which the Japanese translation is posted is "http://www.jga.or.jp/jga/html/jga_data/04KISOKU_NEWS/2008_KISOKU/GrooveMeasurementProcedureOutline(JP).pdf".

The rules are described in English in the rulebook (the 2009 edition) published by R&A (Royal and Ancient Golf Club of Saint Andrews) or the homepage of R&A. In the present application, the golf rules imply the rules defined by the R&A.

Hereinafter, the general description of the rules of the R&A will be described. Hereinafter, the same terms as those of the rules defined by R&A are used. Hereinafter, the face line is also merely referred to as a "groove".

[General Description of Rules of R&A Related to Face Line]

R&A sent out a notification on Feb. 27, 2007. In the notification, R&A proposed that Appendix II, 5c of the golf rules is changed so that the capacity of a groove and the sharpness of an edge are restricted in all clubs other than a driving club (a so-called driver) and a putter. The rules added to the proposal are the present new rules. The new rules are scheduled to be effected from Jan. 1, 2010.

The new rules include the following two additional matters related to all the clubs other than the driving club and the putter.

(New Rule 1)

A value obtained by dividing an area A1 of a transverse plane of a groove by a groove pitch (groove width W1+distance S1) is restricted to 0.003 square inches/inch (0.0762 $mm^2$/mm).

(New Rule 2)

The sharpness of the edge of the groove is restricted to an effective minimum radius of 0.010 inch (0.254 mm).

The area A1, the width W1, and the distance S1 will be described later.

The parameter of the groove is calculated in the procedure related to the determination of the conformity of the groove to the rules. The general description of the calculation procedure for the parameter of the groove will be described in the following items (1) and (2).

(1) Acquisition of Profile of Groove

In the acquisition of the groove profile, first, it is confirmed that deposits, paints, coatings, and the like are not present in an area to be measured. Next, a line perpendicular to a groove of a club face to be traced is determined. For example, the line is a line taken along a line shown in FIG. 2. Measurement is carried out along the line. Examples of a measuring device include "INFINITE FOCUS optical 3D Measurement Device G4f" (trade name) described above and manufactured by Alicona Imaging GmbH.

(2) 30 Degree Method of Measurement

"30 degree method of measurement" is applied for the profile of the measured groove. In the 30 degree method of measurement, contact points CP1 and CP2 of a tangent having an angle of 30 degrees relative to a land area LA and a groove are determined. A distance between the contact point CP1 and the contact point CP2 is defined as a groove width W1 (see FIG. 19, and FIGS. 11 to 14).

Figure 19:
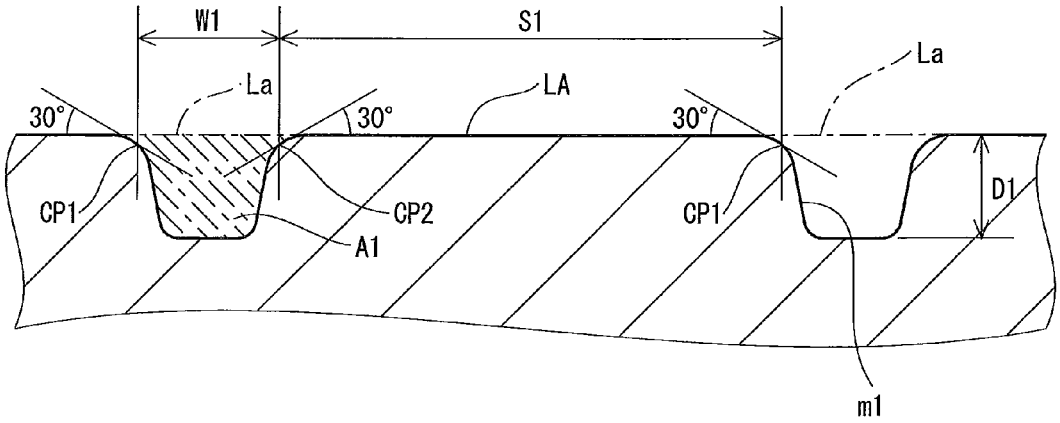
FIG. 19 is a diagram for explaining the golf rules related to a face line.

A distance between the contact point CP2 of the groove and the contact point CP1 of a groove next to the groove is defined as a groove distance S1 (see FIG. 19).

A distance between an extended line La of the land area LA and the lowest point of the section of the groove is defined as a groove depth D1 (see FIG. 19).

An area A1 of the groove is an area of a portion surrounded by the extended line La and the profile (section line) of the groove. The area A1 is an area of a portion shown by hatching of a one-dotted chain line in FIG. 19.

The rules of the golf club including the new rules will be described in the following items (3) to (9).

(3) Groove Width W1

For the groove width W1, when 50% or more of the widths W1 of the measured grooves are more than 0.035 inches (0.889 mm), the club does not meet the rules. The rules are applied to all clubs except a putter.

When at least one of the widths W1 of the measured grooves is more than 0.037 inches (0.940 mm), the club does not meet the rules. The rules are applied to all the clubs except the putter.

(4) Groove Depth

When 50% or more of depths D1 of the measured grooves are more than 0.020 inches (0.508 mm), the club does not meet the rules. When at least one of the depths D1 of the measured grooves is more than 0.022 inches (0.559 mm), the club does not meet the rules. The rules are applied to all the clubs except the putter.

(5) Groove Distance

When 50% or more of the measured groove distances S1 are smaller than three times of the maximum value (the maximum width W1max) of the measured width W1, the club does not meet the rules. When only one of the measured groove distances S1 is smaller than a value obtained by subtracting 0.008 inches (0.203 mm) from three times of the maximum width W1max, the club does not meet the rules. When 50% or more of the measured groove distances S1 are smaller than 0.075 inches (1.905 mm), the club does not meet the rules. When at least one of the measured groove distances S1 is smaller than 0.073 inches (1.854 mm), the club does not meet the rules. These rules are applied to all the clubs except the putter.

(6) Consistency of Groove

The variation (the difference between the maximum value and the minimum value) in the width W1 of the measured groove must not be more than 0.010 inches (0.254 mm). The variation (the difference between the maximum value and the minimum value) in the depth D1 of the measured groove must not be more than 0.010 inches (0.254 mm). The section shapes of the grooves must be symmetric. The grooves must be mutually parallel. The grooves must be deliberately designed and manufactured so as to have consistency in an impact area. The rules are applied to all the clubs except the putter.

(7) [Area A1/(Width W1+Distance S1)]

When 50% or more of values of [A1/(W1+S1)] are more than 0.0030 inches (0.0762 mm), the club does not meet the rules. When at least one of the values of [A1/(W1+S1)] is more than 0.0032 inches (0.0813 mm), the club does not meet the rules. The rules are applied to all the clubs except the driver and the putter.

(8) Radius of Edge

The rules for the roundness of the edge of the groove are defined by the "two circles method" to be described later. When 50% or more of the edges of the upper side grooves or 50% or more of the edges of the lower side grooves do not satisfy the requirements for the two circles method, the club does not meet the rules. However, as described later, an angle of 10 degrees is allowable. When at least one of the edges of the grooves is projected by more than 0.0003 inches (0.0076 mm) out of the outer side circle, the club does not meet the rules. The rules are applied to a club having a loft angle (real loft angle) which is equal to or greater than 25 degrees. More specifically, the rules are applied to all clubs advertised, marked, and measured as the loft angle (real loft angle) which is equal to or greater than 25 degrees.

(9) Two Circles Method

Usually, a side wall of a groove is brought into contact with a land area LA by filleted transition. In order to determine whether such an edge is excessively sharp, a circle having a radius of 0.010 inches is drawn so that the circle contacts a side wall m1 of the groove and the land area LA adjacent to the side wall m1 (see FIGS. 15 to 18). Next, a second circle having a radius of 0.011 inches is drawn. The circle having the radius of 0.011 inches is a concentric circle of the circle having the radius of 0.010 inches (see FIGS. 15 to 18).

Figure 15:
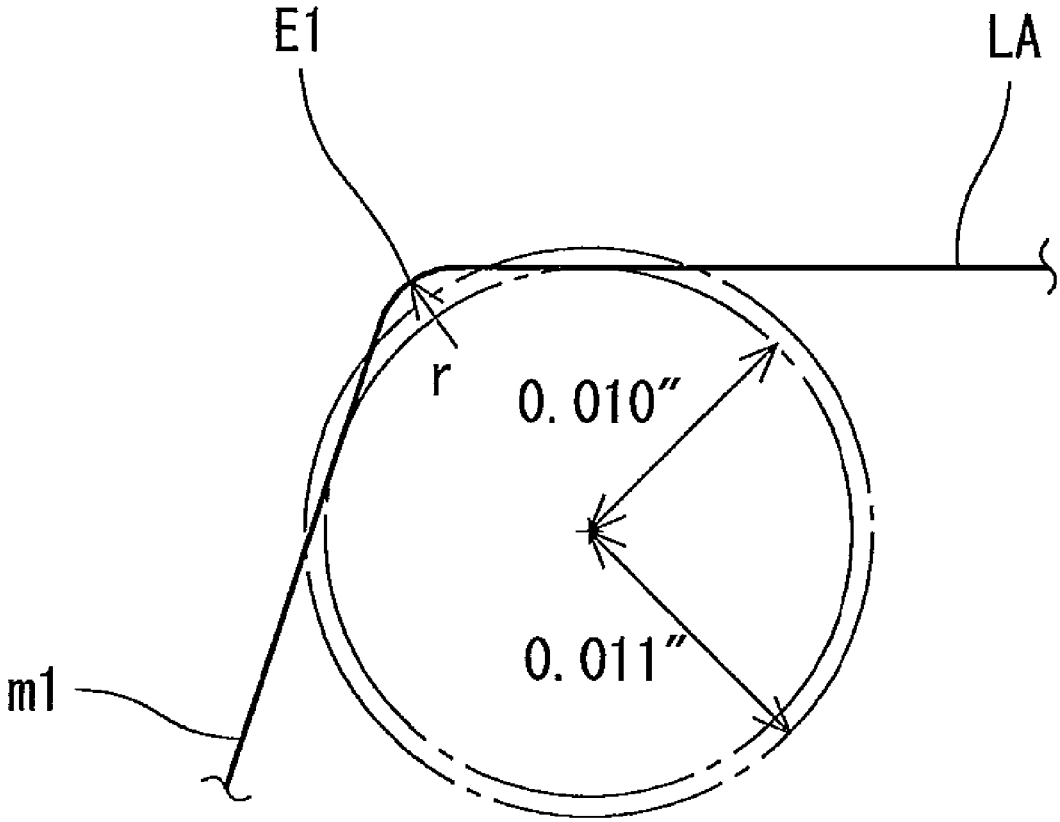
FIG. 15 is a diagram for explaining the two circles method of the golf rules.
Figure 16:
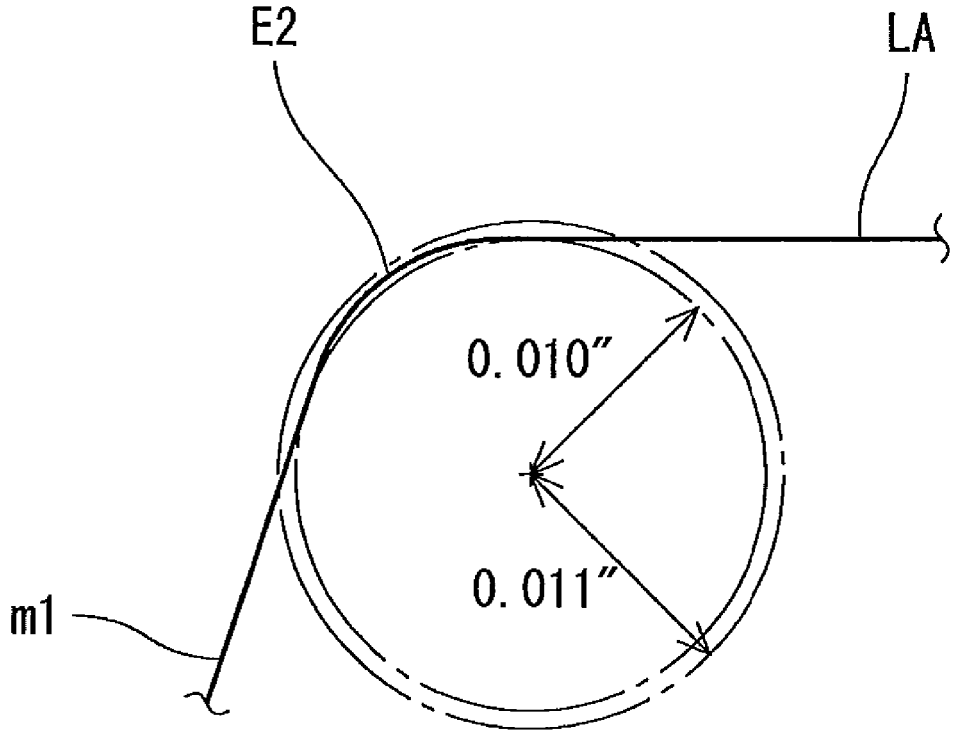
FIG. 16 is a diagram for explaining the two circles method of the golf rules.

When any portion of the edge of the groove is projected from the outer side circle (the circle having the radius of 0.011 inches), the edge of the groove is considered to be excessively sharp. An edge E1 of FIG. 15 is an example of the excessively sharp edge. Since an edge E2 of FIG. 16 is not projected from the outer side circle, the edge E2 is not considered to be excessively sharp.

The following additional standards 1 and 2 are used in order to confirm that a certain groove is actually projected from the outer side circle and the projection is neither an artificial result during measurement nor manufacturing abnormalities, and to determine the conformity to the two circles method.

[Additional Standard 1: Range of Projection Angle from Outer Side Circle]

Figure 17:
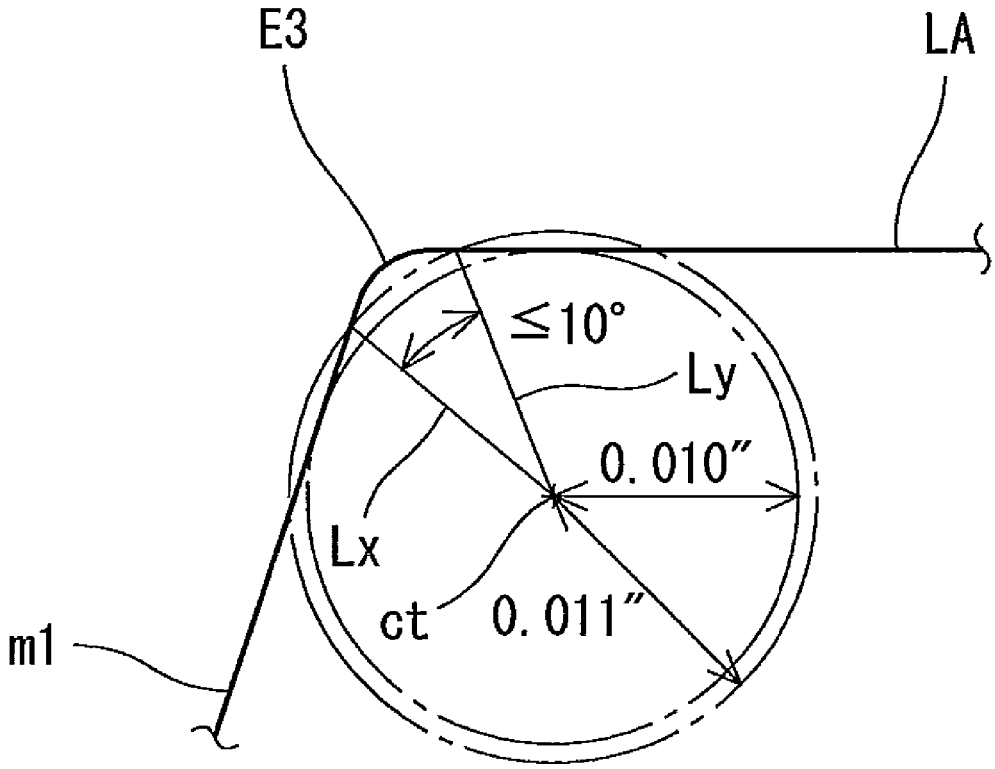
FIG. 17 is a diagram for explaining the two circles method of the golf rules.

As shown in FIG. 17, two lines Lx and Ly connecting a center ct of a concentric circle and a position at which an edge is projected from an outer side circle are drawn. An angle between the two lines Lx and Ly is a projection angle. When the projection angle is greater than 10 degrees in 50% or more of the edges of the upper side grooves or 50% or more of the edges of the lower side grooves, the club does not meet the rules.

[Additional Standard 2: Maximum Projection]

Figure 18:
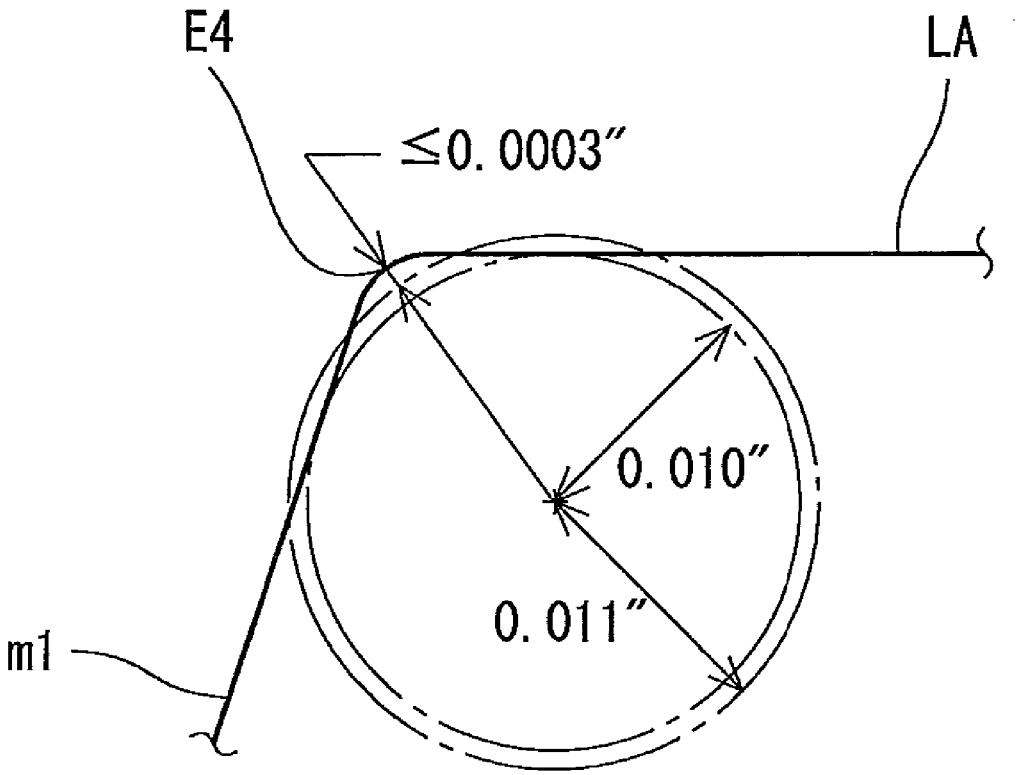
FIG. 18 is a diagram for explaining the two circles method of the golf rules.

When at least one of the edges is projected by more than 0.0003 inches out of the outer side circle as shown by an edge E4 of FIG. 18, the club does not meet the rules.

[The Rules R&A are Described Above]

The present invention can be applied to all the golf club heads provided with the face lines. The present invention can be used for an iron type golf club head, a wood type golf club head, a utility type golf club head, a hybrid type golf club head, a putter type golf club head, or the like.

The description hereinabove is merely for an illustrative example, and various modifications can be made in the scope not to depart from the principles of the present invention.

What is claimed is:

1. A golf club head comprising:

a face; and a face line formed on the face, wherein a depth D1 (mm) of the face line is 0.100 (mm) or greater and 0.508 (mm) or less; and when a first curvature radius is defined as r1 (mm) and a second curvature radius is defined as r2 (mm) in a section of the face line, the first curvature radius r1 is smaller than the second curvature radius r2; and wherein when an upper end point of an edge of the face line is defined as Pa; a point placed at a position of which a depth is 0.015 mm is defined as Pb; a point placed at a position of which a depth is 0.030 mm is defined as Pc; a point placed at a position of which a depth is [(D1−0.03)/2+0.03] (mm) is defined as Pd; and a point placed at a position of which a depth is [D1/4] (mm) is defined as Pe, the first curvature radius r1 is a radius of a circle passing through the point Pa, the point Pb, and the point Pc; and the second curvature radius r2 is a radius of a circle passing through the point Pc, the point Pd, and the point Pe.

TABLE 1

Specifications and Evaluation Results of Examples and Comparative Examples

| | Real loft | Section shape of face line: First curvature radius r1 | Second curvature radius r2 | | Angle (degree) | | | | Groove width W1 | Groove depth D1 | Conformity | Backspin |
|---|---|---|---|---|---|---|---|---|---|---|---|---|
| | (degree) | (mm) | (mm) | r1/r2 | θ1 | θ2 | θ3 | θ4 | (mm) | (mm) | to rules | rate (rpm) |
| Example 1 | 56° | 0.05 | 0.25 | 0.20 | 65 | 50 | 35 | 20 | 0.7 | 0.4 | Good | 6850 |
| Example 2 | 56° | 0.10 | 0.30 | 0.33 | 75 | 60 | 45 | 10 | 0.7 | 0.4 | Good | 6500 |
| Comparative Example 1 | 56° | 0.05 | 0.05 | 1.00 | 80 | 30 | 20 | 20 | 0.7 | 0.4 | Poor | 6900 |
| Comparative Example 2 | 56° | 0.20 | 0.20 | 1.00 | 80 | 45 | 20 | 10 | 0.7 | 0.4 | Good | 5570 |

As shown in Table 1, the manufacturing methods of the examples have higher evaluation than those of the comparative examples.

[Evaluation of Possibility for Damage of Ball]

The damages of the golf balls used for the actual shot test after hitting were visually confirmed. As a result, the comparative example 2 had fewest damages. The example 2 had damages greater than those of the comparative example 2. The example 1 had damages greater than those of the example 2. The comparative example 1 had greatest damages. More specifically, the comparative example 2, the example 2, the example 1 and comparative example 1 are arranged in the ascending order of the number of the damages. It was confirmed that the golf club heads of the examples attain the suppressed damage of the ball and the spin performance and tend to meet the rules.

2. The golf club head according to claim 1, wherein the first curvature radius r1 is 0.050 (mm) or greater and 0.200 (mm) or less; and the second curvature radius r2 is 0.100 (mm) or greater and 0.400 (mm) or less.

3. The golf club head according to claim 1, wherein a ratio (r1/r2) is 0.1 or greater and 0.7 or less.

4. The golf club head according to claim 1, wherein when a straight line connecting the point Pa and the point Pb is defined as Lab; a straight line connecting the point Pb and the point Pc is defined as Lbc; a straight line connecting the point Pc and the point Pd is defined as Lcd; a straight line connecting the point Pd and the point Pe is defined as Lde; a straight line perpendicular to a land area LA of the face is defined as Lp; an angle between the straight line Lab and the straight line Lp is defined as θ1; an angle between the straight line Lbc and the straight line Lp is defined as θ2; an angle between the straight line Lcd and the straight line Lp is defined as θ3; and an angle between the straight line Lde and the straight line Lp is defined as θ4, the angle θ1 is greater than the angle θ2; the angle θ2 is greater than the angle θ3; and the angle θ3 is greater than the angle θ4.

5. The golf club head according to claim 1, wherein when an angle between a tangent at each of points (excluding the point Pa and the point Pd) between the point Pa and the point Pd and the straight line Lp is defined as θ5, the angle θ5 is smaller as the point is nearer to the point Pd.

6. The golf club head according to claim 1, wherein when a straight line connecting the point Pa and the point Pb is defined as Lab; a straight line perpendicular to a land area LA of the face is defined as Lp; and an angle between the straight line Lab and the straight line Lp is defined as θ1, the angle θ1 is 45 degrees or greater and 89 degrees or less.

7. The golf club head according to claim 4, wherein the angle θ1 is 45 degrees or greater and 89 degrees or less.

8. The golf club head according to claim 1, wherein when a straight line connecting the point Pb and the point Pc is defined as Lbc; a straight line perpendicular to a land area LA of the face is defined as Lp; and an angle between the straight line Lbc and the straight line Lp is defined as θ2, the angle θ2 is 40 degrees or greater and 80 degrees or less.

9. The golf club head according to claim 4, wherein the angle θ2 is 40 degrees or greater and 80 degrees or less.

10. The golf club head according to claim 1, wherein when a straight line connecting the point Pc and the point Pd is defined as Lcd; a straight line perpendicular to a land area LA of the face is defined as Lp; and an angle between the straight line Lcd and the straight line Lp is defined as θ3, the angle θ3 is 20 degrees or greater and 70 degrees or less.

11. The golf club head according to claim 4, wherein the angle θ3 is 20 degrees or greater and 70 degrees or less.

12. The golf club head according to claim 1, wherein when a straight line connecting the point Pd and the point Pe is defined as Lde; a straight line perpendicular to a land area LA of the face is defined as Lp; and an angle between the straight line Lde and the straight line Lp is defined as θ4, the angle θ4 is 3 degrees or greater and 45 degrees or less.

13. The golf club head according to claim 4, wherein the angle θ4 is 3 degrees or greater and 45 degrees or less.

14. The golf club head according to claim 1, wherein the section of the face line is smoothly continuously formed between the point Pa and the point Pd.

15. The golf club head according to claim 4, wherein the angle θ1 is 45 degrees or greater and 89 degrees or less;

the angle θ2 is 40 degrees or greater and 80 degrees or less;

the angle θ3 is 20 degrees or greater and 70 degrees or less; and the angle θ4 is 3 degrees or greater and 45 degrees or less.

16. The golf club head according to claim 1, wherein the face line has a bottom surface, a plane inclined part and a protruded curved surface; the bottom surface is a plane;

the plane is parallel to the land area LA; and all or part of the protruded curved surface is the edge.

17. The golf club head according to claim 16, wherein the protruded curved surface and the plane inclined part are smoothly continuously formed.

18. The golf club head according to claim 16, wherein when an angle between a straight line perpendicular to the land area LA and the plane inclined part gc3 in the section of the face line is defined as θg2, the angle θg2 is 2 degrees or greater and 45 degrees or less.

19. The golf club head according to claim 1, wherein the face line is formed by a cutter which is axially rotated.

* * * * *